US012016508B2

(12) United States Patent
Yeom et al.

(10) Patent No.: US 12,016,508 B2
(45) Date of Patent: Jun. 25, 2024

(54) DISH WASHER AND CONTROLLING METHOD THEREOF

(71) Applicant: SAMSUNG ELECTRONICS CO., LTD., Suwon-si (KR)

(72) Inventors: Daeseon Yeom, Suwon-si (KR); Jungchan Ryu, Suwon-si (KR); Junho Lee, Suwon-si (KR); Minho Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 58 days.

(21) Appl. No.: 17/703,575

(22) Filed: Mar. 24, 2022

(65) Prior Publication Data

US 2023/0041312 A1 Feb. 9, 2023

Related U.S. Application Data

(63) Continuation of application No. PCT/KR2021/018217, filed on Dec. 3, 2021.

(30) Foreign Application Priority Data

Aug. 5, 2021 (KR) ..... 10-2021-0103091

(51) Int. Cl.
*A47L 15/42* (2006.01)
*A47L 15/00* (2006.01)

(52) U.S. Cl.
CPC ..... *A47L 15/4206* (2013.01); *A47L 15/0023* (2013.01); *A47L 15/421* (2013.01); *A47L 15/4223* (2013.01)

(58) Field of Classification Search
None
See application file for complete search history.

(56) References Cited

U.S. PATENT DOCUMENTS

| | | | | |
|---|---|---|---|---|
| 9,510,725 | B2 | 12/2016 | Lee et al. | |
| 2011/0290284 | A1 | 12/2011 | Chung et al. | |
| 2022/0240748 | A1* | 8/2022 | Kim | A47L 15/4231 |
| 2023/0148829 | A1* | 5/2023 | Park | A47L 15/4229 134/109 |

FOREIGN PATENT DOCUMENTS

| | | |
|---|---|---|
| EP | 0 990 413 B1 | 12/2003 |
| EP | 2 820 997 A2 | 1/2015 |

(Continued)

OTHER PUBLICATIONS

International Search Report dated May 3, 2022 issued in PCT Application No. PCT/KR2021/018217.

*Primary Examiner* — Rita P Adhlakha
(74) *Attorney, Agent, or Firm* — STAAS & HALSEY LLP

(57) ABSTRACT

A dish washer includes a cabinet, a tub positioned inside the cabinet, a sump provided in a lower portion of the tub, a case brake provided on a side wall of the tub connected to the sump, and a filter device positioned below the tub inside the cabinet, to selectively filter or unfilter water received from a water supply source, and to supply the filtered water or the unfiltered water to the case brake, the water passed through the case brake is collected in the sump, the case brake is located higher than the sump to prevent a backflow of the water collected in the sump to the case brake.

11 Claims, 16 Drawing Sheets

(56) References Cited

FOREIGN PATENT DOCUMENTS

| | | | |
|---|---|---|---|
| KR | 94-18962 | U | 8/1994 |
| KR | 1997-0026919 | A | 6/1997 |
| KR | 10-0432697 | B1 | 9/2004 |
| KR | 10-0447757 | B1 | 10/2004 |
| KR | 20-0368994 | Y1 | 12/2004 |
| KR | 20-0368995 | Y1 | 12/2004 |
| KR | 10-2006-0036751 | A | 5/2006 |
| KR | 10-2006-0095838 | A | 9/2006 |
| KR | 10-0682655 | B1 | 2/2007 |
| KR | 10-0808260 | B1 | 2/2008 |
| KR | 10-2008-0081572 | A | 9/2008 |
| KR | 10-2011-0131920 | | 12/2011 |
| KR | 10-1135855 | B1 | 4/2012 |
| KR | 10-2014-0101633 | | 8/2014 |
| KR | 10-2015-0094328 | A | 8/2015 |
| KR | 10-2019-0014896 | A | 2/2019 |
| KR | 10-2019-0105887 | A | 9/2019 |
| WO | WO 2020/094297 | A1 | 5/2020 |

* cited by examiner

DISH WASHER AND CONTROLLING METHOD THEREOF

CROSS-REFERENCE TO RELATED APPLICATIONS

This application is a Continuation of PCT Application No. PCT/KR2021/018217, filed Dec. 3, 2021 which claims the priority benefit of Korean Application No. 10-2021-0103091, filed Aug. 5, 2021, the contents of both of which are incorporated by reference herein in their entirety.

BACKGROUND

1. Field

The disclosure relates to a dish washer, and more particularly, a dish washer with an improved structure.

2. Description of the Related Art

Generally, a dish washer is equipment for spraying washing water to dishes accommodated therein with high pressure, washing the dishes, and then drying the dishes. The dish washer operates to spray washing water toward the inside of a washing tub in which dishes are accommodated with high pressure to cause the sprayed washing water to collide with the dishes and wash out foreign materials such as food residues remaining on the surfaces of the dishes.

More specifically, the dish washer is configured with a tub forming the washing tub and a sump installed in the bottom of the tub to store washing water. Washing water moves to a spraying nozzle by a pumping operation of a washing pump installed inside the sump, and the washing water moved to the spraying nozzle is sprayed with high pressure through a spraying hole formed at the end of the spraying nozzle. The washing water sprayed with high pressure collides with the surfaces of dishes so that dirt such as food residues remaining on the dishes falls to the bottom of the tub.

In the dish washer, washing water is collected in the sump to be supplied to the inside of the tub. There is a desire to use purified washing water as washing water collected in the sump.

SUMMARY

An aspect of the disclosure is directed to providing a dish washer capable of easily replacing a filter installed inside a cabinet.

Another aspect of the disclosure is directed to providing a dish washer for causing water supplied from a water supply source and bypassing a filter to be supplied to a sump or water passed through the filter to be supplied to the sump.

Additional aspects will be set forth in part in the description which follows and, in part, will be apparent from the description, or may be learned by practice of the example embodiments.

A dish washer according to an embodiment of the disclosure includes: a cabinet; a tub disposed in the cabinet; a sump provided in a lower portion of the tub; a case brake provided on a side wall of the tub and connected to the sump; and a filter device disposed below the tub in the cabinet, to selectively filter or unfilter water received from a water supply source, and to supply the filtered water or the unfiltered water to the case brake, wherein the water passed through the case brake is collected in the sump, the case brake is located higher than the sump to prevent a backflow of the water collected in the sump to the case brake.

The dish washer may further include a machine room provided below the tub in the cabinet, and wherein the filter device is installed in the machine room, and the filter device may include a filter case disposed in the machine room and protruded toward inside of the tub such that a portion of the filter case is positioned in inside of the tub.

The filter case may include: a first case to support the filter device inside the machine room; a second case disposed above the first case; and a third case disposed above the second case and penetrated a bottom of the tub to protrude to the inside of the tub such that the portion of the filter case is disposed in the inside of the tub.

The filter device may further include a case cover detachably coupled with the third case and positioned inside the tub.

A filter may be accommodated in the second case and the third case, and the third case may include a coupling portion provided in an upper portion of the third case and coulable with the case cover, the coupling portion located higher than the bottom of the tub so that the filter is insertable to or removable from the filter case via the inside of the tub.

The case cover portion may include: a cover to cover a top of the filter; and a fixing protrusion protruded from the cover portion to be fixed to the filter.

The case brake may include: a case; an internal flow path formed in the case and through which the filtered water or the unfiltered water flows, the internal flow path including an inlet through which the filtered water or the unfiltered water from the filter device enteres and an outlet provided in a lower portion of the case so that the water, flows through the internal flow path, is supplied to the sump, the outlet located higher than the sump; an air brake provided at an upper end on the internal flow path to prevent the backflow of water from the sump to the case; and an air brake hole formed in the air brake such that inside pressure of the internal flow path is balanced with outside pressure of the case.

The filter device may include: a filter case; a filtering flow path formed inside the filter case so that the received water flows therethrough and filtered by the filter; and a bypass flow path formed inside the filter case so that the received water flows therethrough and bypasses the filter.

The filter device may include: a first valve to open the filtering flow path so that water passed through the filter flows to the case brake; and a second valve to open the bypass flow path so that water bypassed the filter flows to the case brake.

The dish washer may further include a controller to selectively operate the first valve to open or close the filtereing flow path or the second valve to open or close the bypass flow path.

The controller may perform a plurality of rinsing operations of spraying water, and the controller may control the first valve to open the filtering flow path in a final rinsing operation among the plurality of rinsing operations of spraying water such that filtered water flows to the case brake.

The dish washer may further include user interface to receive a user input, and the controller may selectively operate the first valve or the second valve based on the user input.

A dish washer according to an embodiment of the disclosure includes: a washing chamber; a sump positioned in a lower portion of the washing chamber, a case brake provided on one side of the washing chamber and connected to the sump; a filter device to supply washing water to the case brake, wherein the filter device includes a filter case, a filter insertable to or removable from the filter case, a filtering flow path formed inside the filter case so that water received from a water source flows therethrough and filtered by the filter, and a bypass flow path formed inside the filter case such that water bypasses the filter.

The filter device may include: a first valve to open or close the filtering flow path; and a second valve to open or close the bypass flow path.

The filter device may include: an inlet formed in the filter case; a first outlet formed in the filter case such that water on the filtering flow path passes through the case brake and flows to the sump; and a second outlet formed in the filter case such that water on the bypass flow path passes through the case brake and flows to the sump.

The dish washer may further include a controller to selectively operate the first valve to open or close the filtering flow path or the second valve to open or close the bypass flow path.

The controller performs a plurality of operations of spraying water inside the tub, and may operate the first valve in a final operation among the plurality of operations of spraying water such that filtered water passes through the case brake and flows to the sump.

A method of controlling a dish washer, according to an embodiment of the disclosure, the dish washer including a filter device to selectively filter or unfilter water, a case brake through which the filtered water or unfiltered water pass, a sump to which the water passed through the case brake is supplied, includes: detecting an operation of filtering water received from a water supply source through a filter included in the filter device from among operations of the dish washer; in response to the detecting of an operation of filtering: opening a filtering flow path formed in the filter device so that the received water is filtered by the filter; supplying the filtered water to the case brake which is located higher than the filter device; and supplying the water passed through the case brake to the sump, the case brake located higher than the sump to prevent a backflow of the water collected in the sump to the case brake and in response to not detecting of an operation of filtering: opening a bypass flow path formed in the filter device so that the received water bypasses the filter; supplying the unfiltered water to the case brake; and supplying the water passed through the case brake to the sump, when the operation of passing water through the filter is not detected.

The opening of the filtering flow path may include operating a first valve to open the filtering flow path, and the opening of the bypass flow path may include operating a second valve to open the bypass flow path.

The dish washer may include a plurality of rinsing operations including spraying water inside of the tub, wherein the opening of the filtering flow path may include opening the filtering flow path in a final rinsing operation among the plurality of rinsing operations.

According to a concept of the disclosure, there is provided a dish washer capable of preventing water collected in a sump from flowing backward because a case brake is located higher than the sump.

According to a concept of the disclosure, there is provided a dish washer capable of extending a life cycle of a filter by supplying water bypassing the filter to a sump as necessary.

DETAILED DESCRIPTION

Figure 1:
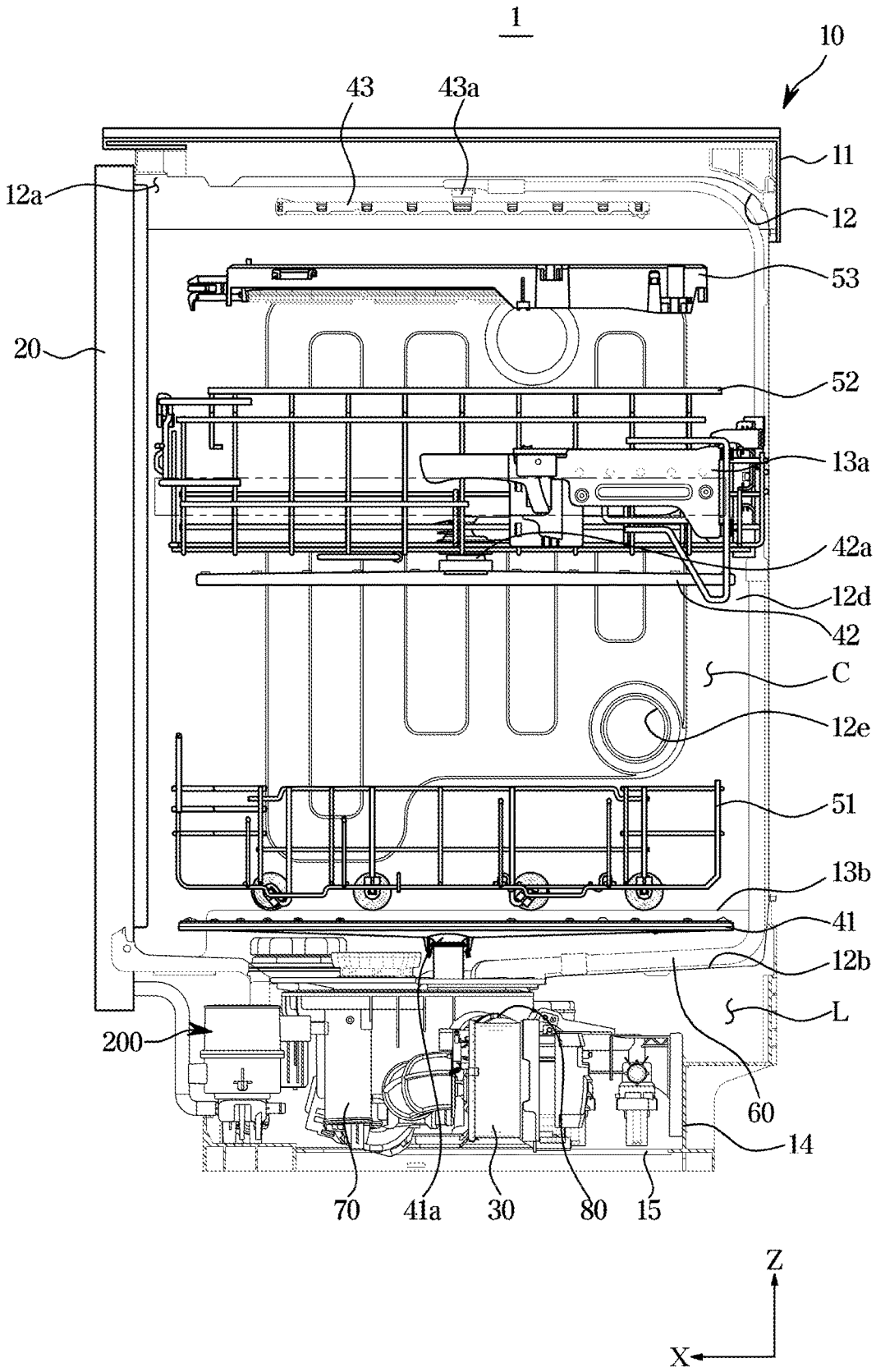
FIG. 1 is a cross-sectional view showing a dish washer according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms "first," "second," etc. may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

In the following description, the terms "front direction", "rear direction", "left portion" and "right portion" are defined based on the drawings, and the shapes and positions of the corresponding components are not limited by the terms.

Hereinafter, the embodiments of the disclosure will be described in detail with reference to the accompanying drawings.

Figure 2:
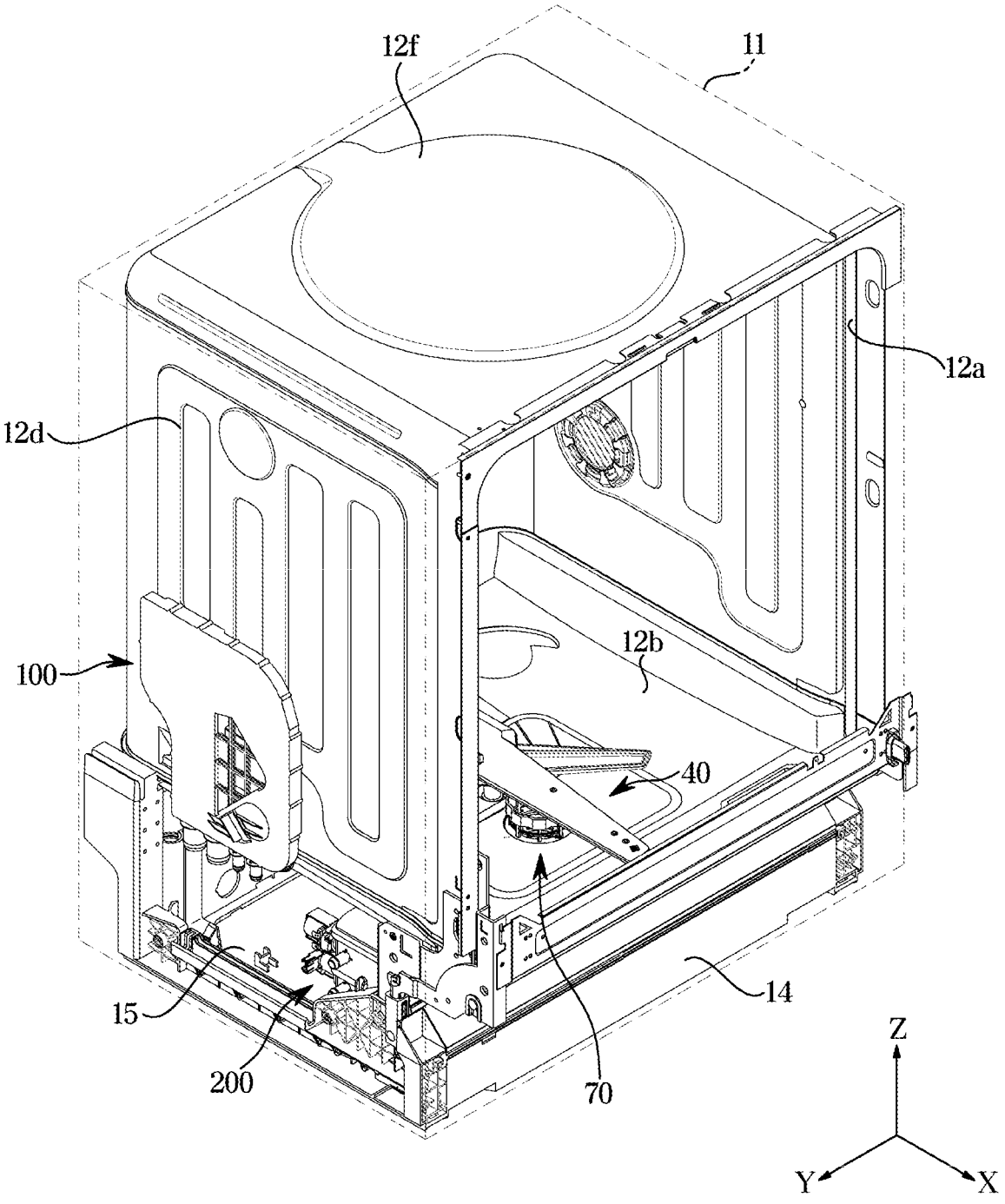
FIG. 2 is a perspective view showing a state in which a case brake is coupled with a tub in the dish washer of FIG. 1.

FIG. 1 is a cross-sectional view showing a dish washer according to an embodiment of the disclosure. FIG. 2 is a perspective view showing a state in which a case brake is coupled with a tub in the dish washer of FIG. 1.

Referring to FIGS. 1 and 2, a dish washer 1 may include a main body 10 forming an outer appearance. The main body 10 may include a cabinet 11 forming the outer appearance of the dish washer 1, and a tub 12 installed inside the cabinet 11. The tub 12 may be in the shape of substantially a box. One side of the tub 12 may open. That is, the tub 12 may include an open side 12*a*. For example, a front side of the tub 12 may open.

The dish washer 1 may further include a door 20 for opening and closing the open side 12*a* of the tub 12. The door 20 may be mounted on the main body 10 to open and close the open side 12*a* of the tub 12. The door 11 may be rotatably mounted on the cabinet 11.

The dish washer 1 may further include an accommodating container positioned inside the tub 12 to accommodate dishes.

The accommodating container may include a plurality of baskets 51, 52, and 53. In the plurality of baskets 51, 52, and 53, dishes having relatively large volumes may be accommodated. However, kinds of dishes that are accommodated in the plurality of baskets 51, 52, and 53 are not limited to dishes having relatively large volumes. That is, in the plurality of baskets 51, 52, and 53, dishes having relatively small volumes, as well as dishes having relatively large volumes, may also be accommodated.

The plurality of baskets 51, 52, and 53 may include a middle basket 52 located at a middle area in a height direction of the dish washer 1, and a lower basket 51 located at a lower area in the height direction of the dish washer 1. The middle basket 52 may be supported on a middle guide rack 13*a*, and the lower basket 51 may be supported on a lower guide rack 13*b*. The middle guide rack 13*a* and the lower guide rack 13*b* may be mounted on inner surfaces of side walls 12*d* of the tub 12 such that the middle basket 52 and the lower basket 51 slide toward the open side 12*a* of the tub 12.

The plurality of baskets 51, 52, and 53 may include an upper basket 53 located at an upper area in the height direction of the dish washer 1. The upper basket 53 may be formed in the shape of a rack assembly to accommodate dishes having relatively small volumes. Preferably, in the upper basket 53, cooking tools, such as a ladle, a knife, a spatula, and the like, or cutlery may be accommodated. Also, in the rack assembly, a small cup such as an espresso cup may be accommodated. However, kinds of dishes that are accommodated in the upper basket 53 are not limited to the above-mentioned examples.

The dish washer 1 may further include a sump 70 for storing washing water. The dish washer 1 may include a washing chamber C which is a space formed by the inside of the tub 12. The washing chamber C may be a space in which dishes accommodated in the baskets 51, 52, and 53 are washed by washing water and dried.

The washing chamber C may be defined as an inside space of the tub 12, formed by a top wall 12*f*, side walls 12*d*, a front wall, a rear wall 12*c*, and a bottom 12*b* of the tub 12 and the sump 70 communicating with the bottom 12*b*.

The dish washer 1 may further include spray units 41, 42, and 43 configured to spray washing water. The spray units 41, 42, and 43 may include a first spray unit 41 located below the lower basket 51 in the height direction of the dish washer 1, a second spray unit 42 located below the middle basket 52 in the height direction of the dish washer 1, and a third spray unit 43 located above the upper basket 53 in the height direction of the dish washer 1.

The first spray unit 41 may be rotatable on a rotating shaft 41*a*, the second spray unit 42 may be rotatable on a rotating shaft 42*a*, and the third spray unit 43 may be rotatable on a rotating shaft 43*a*.

However, the disclosure is not limited to the embodiment, and the first spray unit 41 may be fixed to one side of the bottom 12*b*, unlike the second spray unit 42 and the third spray unit 43. In this case, the first spray unit 41 may spray washing water in a substantially horizontal direction through a fixed nozzle, and washing water sprayed in the horizontal direction through the nozzle of the first spray unit 41 may change its direction by a turning assembly (not shown) positioned inside the washing chamber C to head upward.

The third spray unit 43 may spray washing water toward dishes accommodated in the upper basket 53, the middle basket 52, and the lower basket 51, and the second spray unit 42 may spray washing water toward dishes accommodated in the middle basket 52 and the upper basket 53.

The first spray unit 41 may be coupled with the bottom 12*b* of the tub 12, unlike the second spray unit 43 and the third spray unit 43. More specifically, the first spray unit 41 may be fixed to the sump 70.

The dish washer 1 may include a circulating pump 30 for pumping water stored in the sump 70 to the spray units 41, 42, and 43. Washing water pumped by the circulating pump 30 may be supplied to the first spray unit 41 through an alternating device 80 connected to the circulating pump 30, or may move upward by a duct 60 to be supplied to the second spray unit 42 or the third spray unit 43.

As described above, washing water stored in the sump 70 or washing water entered the inside of the dish washer 1 from the outside may move to the alternating device 80 by the circulating pump 30. The alternating device 80 may provide washing water to the first spray unit 41 through a connector (not shown) connected to the first spray unit 41, and provide washing water to the duct 60 through a flow path 62 connected to the duct 60.

The alternating device 80 may selectively provide washing water to at least one of the connector and the duct 60. The alternating device 80 may be positioned in a machine room L provided below the washing chamber C.

The dish washer 1 may include the machine room L provided below the tub 12. The machine room L may be defined by a lower frame 14 and a bottom plate 15.

In the machine room L, components, such as the circulating pump 30, the sump 70, and the alternating device 80 as described above, may be positioned, and a water supply hose and a drain hose, which will be described later, may be positioned.

The dish washer 1 may include a case brake 100 coupled with the side wall 12*d* of the tub 12. For example, the case brake 100 may be coupled with an outer side wall of the tub 12. Also, the case brake 100 may be positioned at a lower portion of the outer side wall of the tub 12. The case brake 100 may receive water from a filter device 200. The case brake 100 may guide water to the sump 70. In FIG. 2, a hose connecting the case brake 100, the sump 70, and/or the filter device 200 is not shown.

The case brake 100 may be connected to a communicating hole 12*e* formed in the side wall 12*d* of the tub 12. For example, a tub communicating hole 113 of the case brake 100 may communicate with the communicating hole 12*e* of the tub 12.

Figure 5:
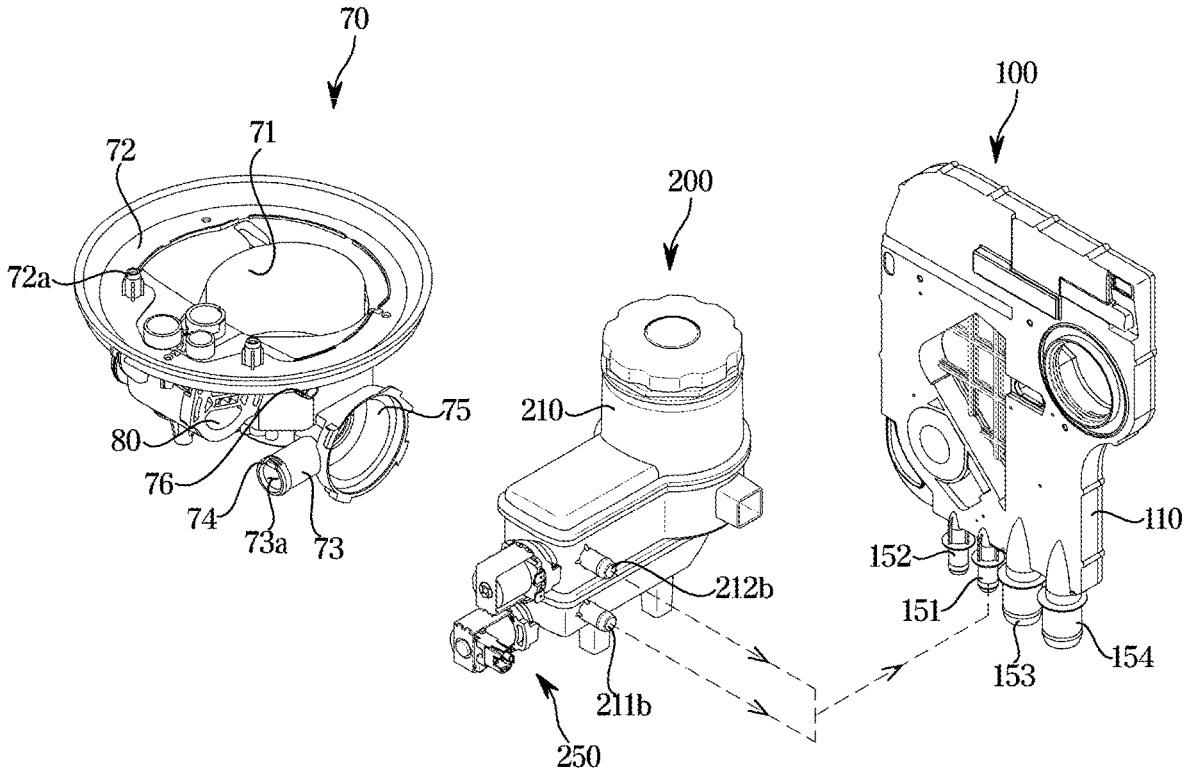
FIG. 5 is a perspective view showing some components positioned below the tub in the dish washer shown in FIG. 3.

The case brake 100 may include a case 110 (see FIG. 5). The case 110 may be coupled with the side wall 12*d* of the tub 12. The case 110 may include the tub communicating hole 113 formed in the second case 112 such that the case brake 100 is coupled with the side wall 12*d* of the tub 12. The tub communicating hole 113 may be coupled with the outer side wall of the tub 12 by a coupling member (not shown) that is coupled with an inner side wall of the tub 12.

The dish washer 1 may include a filter device 200 for filtering water to be supplied to the sump 70 from the outside. The filter device 200 may receive water from the outside. The filter device 200 may be positioned upstream of the case brake 100, and send purified water to the case brake 100. The filter device 200 may be positioned below the tub 12. The filter device 200 may be positioned in the machine room L. For example, a portion of the filter device 200 may be positioned below the bottom 12*b* of the tub 12. The filter device 200 may be accommodated inside the cabinet 11. Accordingly, the filter device 200 may be not exposed to the outside as long as the door 20 is not opened. However, a portion of the filter device 200 may penetrate the bottom 12*b* of the tub 12 to be exposed to inside of the washing chamber C. A user may replace a filter of the filter device 200 by opening the washing chamber C. For example, a portion of a filter case 210 may be positioned below the tub 12, and the other portion of the filter case 210 may penetrate the bottom 12*b* of the tub 12 to be positioned inside the washing chamber C. When the user replaces the filter, the user may open the washing chamber C, separate a case cover 230 coupled with the filter case 210, and then replace the filter accommodated in the filter case 210.

Because the filter device 200 is positioned inside the cabinet 11, water leaking out of the filter device 200 may not leak out of the cabinet 11. Accordingly, furniture located close to the dish washer may be not damaged. Also, a leakage sensor 320 (FIG. 16) may be provided on the bottom plate 15, and, when water leaks from the filter device 200, a user may recognize the leakage through a user interface 310. Details about this will be described with reference to FIG. 15, later.

Figure 3:
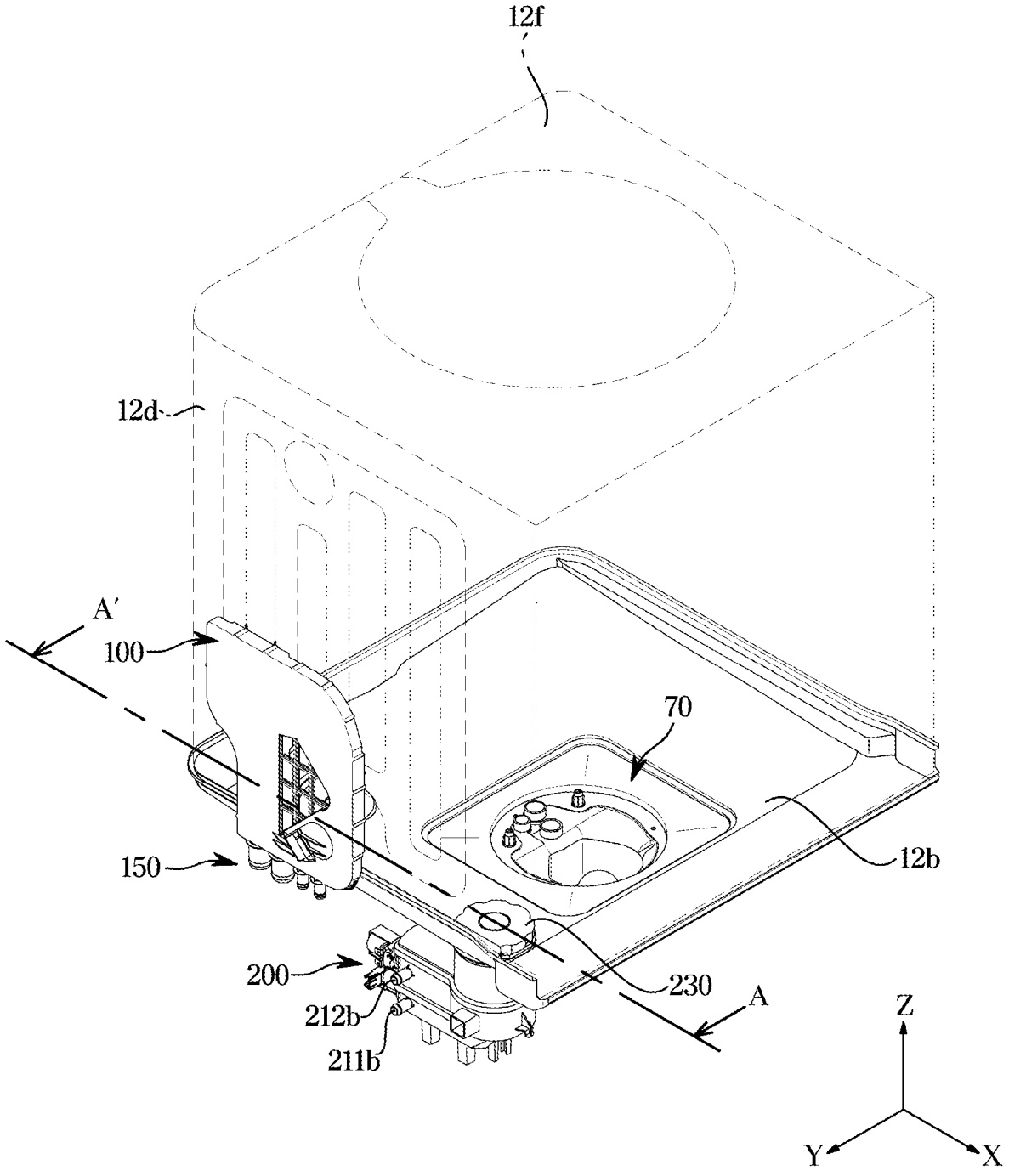
FIG. 3 is a perspective view showing some components in the dish washer shown in FIG. 1.
Figure 4:
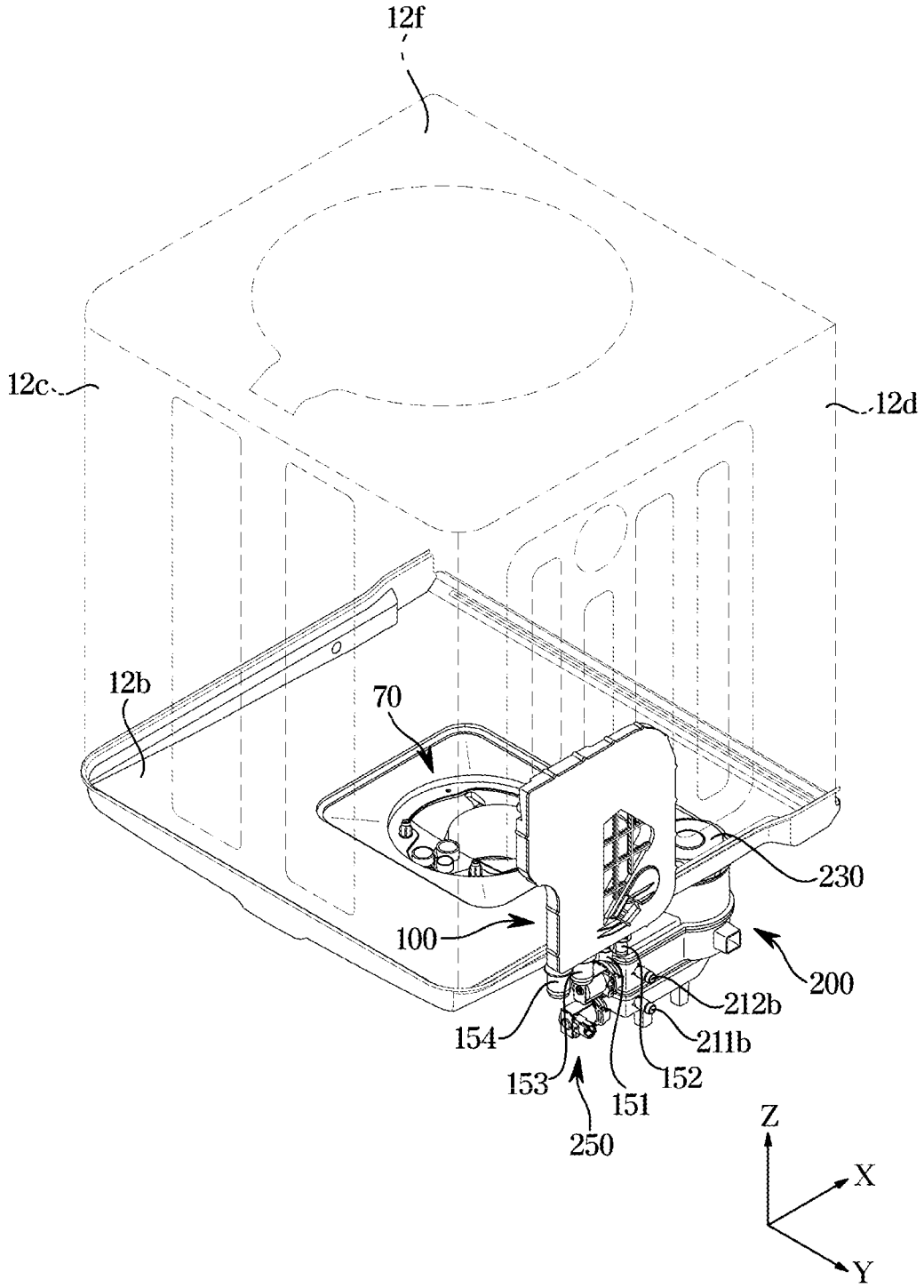
FIG. 4 is a perspective view showing the dish washer shown in FIG. 3 at another angle.
Figure 6:
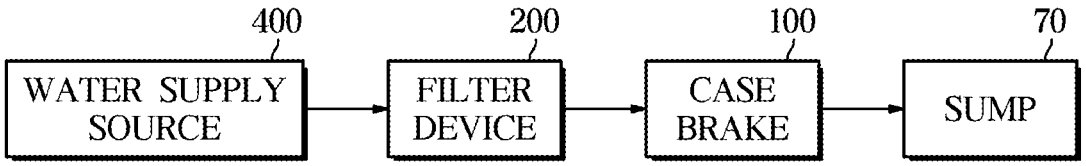
FIG. 6 is a block diagram showing a flow of water in the dish washer shown in FIG. 1.

FIG. 3 is a perspective view showing some components in the dish washer shown in FIG. 1. FIG. 4 is a perspective view showing the dish washer shown in FIG. 3 at another angle. FIG. 5 is a perspective view showing some components positioned below the tub in the dish washer shown in FIG. 3. FIG. 6 is a block diagram showing a flow of water in the dish washer shown in FIG. 1.

In FIG. 5, the tub 12 shown in FIG. 4 is omitted, and the case brake 100 rotated to an angle of 90 degrees with respect to the sump 70 and the filter device 200 is shown. Also, in FIGS. 3 to 5, a hose connecting the case brake 100, the sump 70, and/or the filter device 200 is not shown.

Referring to FIGS. 3 to 6, the dish washer 1 according to an embodiment of the disclosure may include the tub 12, the sump 70, the case brake 100, and the filter device 200.

The filter device 200 may be positioned inside the cabinet 11. The filter device 200 may be positioned in the machine room L. The filter device 200 may be positioned below the bottom 12*b* of the tub 12. However, a portion of the filter device 200 may be exposed to the inside of the washing chamber C from the bottom 12*b* of the tub 12.

The filter device 200 may include an inlet tube 211*a* (FIG. 10), outlet tubes 211*b* and 212*b*, and a valve 250. The inlet tube 211*a* may receive water from a water supply source 400 located outside the dish washer.

The outlet tubes 211*b* and 212*b* may enable water passed through the filter device 200 to flow to the case brake 100. The outlet tubes 211*b* and 212*b* may be connected to an inlet tube 151 of the case brake 100 through an inlet hose 151*a*. A plurality of outlet tubes 211*b* and 212*b* may be provided. The outlet tubes 211*b* and 212*b* may include a first outlet tube 211*b* and a second outlet tube 212*b*. The first outlet tube 211*b* and the second outlet tube 212*b* may be connected to the inlet tube 151 of the case brake 100.

The valve 250 may open or close an internal flow path of the filter device 200 to cause water flowing to the filter device 200 from the outside to pass through the filter or bypass the filter. The valve 250 may include a solenoid valve 250 and/or a thermo actuator 250. However, a kind of the valve 250 is not limited to the above-mentioned examples, and the valve 250 may include various valves 250. For example, the valve 250 may include a three way valve or a four way valve.

A plurality of valves 250 may be provided. The plurality of valves 250 may include a first valve 251 and a second valve 252. When the first valve 251 opens, water filtered in the filter device 200 may flow to the case brake 100 through the first outlet tube 211*b*. When the second valve 252 opens, water bypassing the filter without filtering in the filter device 200 may flow to the case brake 100 through the second outlet tube 212*b*. The first valve 251 may be a filtering valve 251. The second valve 252 may be a bypass valve 252.

The sump 70 may include a water collecting portion 71, a resting portion 72, a drain tube 73, a check valve 74, a drain pump coupling portion 75, and a sump inlet tube 76.

The water collecting portion 71 may collect water passed through the filter device 200 and the case brake 100 in this order. The water collecting portion 71 may open to collect water. The water collecting portion 71 may be an opening of the sump 70.

On the resting portion 72, the bottom 12*b* of the tub 12 may be rested. The tub 12 may be coupled with the sump 70. For example, a coupling protrusion 72*a* provided on the resting portion 72 may penetrate the bottom 12*b* of the tub 12 so that the bottom 12*b* of the tub 12 may be coupled with the resting portion 72.

The drain tube 73 may drain water collected in the water collecting portion 71. The drain tube 73 may enable water to flow to inside of a sump drain connecting tube 153 of the case brake 100 through a drain hole 73*a*. The water entered the inside of the case brake 100 through the sump drain connecting tube 153 may be discharged to the outside through a drain hose connecting tube 154.

The drain tube 73 may be coupled with the check valve 74. The check valve 74 may prevent water from flowing backward. The check valve 74 may be coupled with one end of the drain tube 73.

The sump inlet tube 76 may collect water passed through the filter device 200 and the case brake 100 in order in the sump 12. The sump inlet tube 76 may be connected to a hose 152*a* connected to an outlet tube 152 of the case brake 100. Accordingly, water existing in the case brake 100 may flow to the sump 70 via the sump inlet tube 76 and be collected in the water collecting portion 71.

The drain pump coupling portion 75 may be coupled with a drain pump (not shown) which pumps water collected after a washing operation to drain the water.

The case brake 100 may include a case 110, and a plurality of tubes 151, 152, 153 and 154 provided in a lower portion of the case 110. Water existing in the case 110 to be supplied to the sump 70 and water drained from the sump 70 may flow through the tubes 150. In FIG. 5, the tub 12 shown in FIG. 4 is omitted, and the case brake 100 rotated to an angle of 90 degrees with respect to the sump 70 and the filter device 200 is shown.

The case brake 100 may include the case 110. The case 110 may be coupled with the side wall 12*d* of the tub 12. The case 110 may include the tub communicating hole 113 formed in the second case 112 such that the case brake 100 is coupled with the side wall 12*d* of the tub 12. The tub communicating hole 113 may be coupled with the outer side wall of the tub 12 by the coupling member (not shown) that is coupled with the inner side wall of the tub 12 (see FIGS. 2 and 3).

Water may enter the filter device 200 from the water supply source 400 located outside the dish washer. The filter device 200 may purify water flowing therein through a filter 220 provided inside the filter case 210. Water passed through the filter device 200 may enter the case brake 100. The case brake 100 may be located higher than the filter device 200. For example, an inlet 121 of the case brake 100 may be located higher than outlets 240*b* and 240*c* of the filter device 200. Because water continues to be supplied to the filter device 200 from the water supply source 400, water passed through the filter device 200 may enter the filter case 210 through the inlet 121 due to water pressure although the filter device 200 is located lower than the case brake 100. In the case 110 of the case brake 100, a flowmeter 140 may be provided. The flowmeter 140 may measure an amount of water entered the case brake 100 via the filter device 200. Water passed through the case brake 100 may flow to the sump 70. The water flown to the sump 70 may be collected and then flow to a spray unit 40 via the alternating device 80. That is, water supplied from the outside may flow in an order of the filter device 200, the case brake 100, and the sump 70. A lowermost portion of the case brake 100 may be located higher than the water collecting portion 71 of the sump 70. For example, an outlet 122 formed in a lower portion of the case brake 100 and lower ends of the tubes 150 arranged in the lower portion may be located higher than an uppermost position of the water collecting portion 71.

Accordingly, potential energy of water in the case brake 100 may be greater than potential energy of water in the sump 70 although water is collected in the sump 70. Therefore, the water collected in the sump 70 may be prevented from flowing backward to the case brake 100.

Also, because water passed through the filter device 200 enters the case brake 100, the flowmeter 140 in the case brake 100 may measure a flow rate of water passed through the filter device 200. Thereafter, the water may pass through the case brake 100 and then be directly supplied to the sump 70. Therefore, the nearly same flow rate as the flow rate measured by the flowmeter 140 may be supplied to the sump 70. That is, there may be little difference between the flow rate measured by the flowmeter 140 and a flow rate in the water collecting portion 71.

Figure 7:
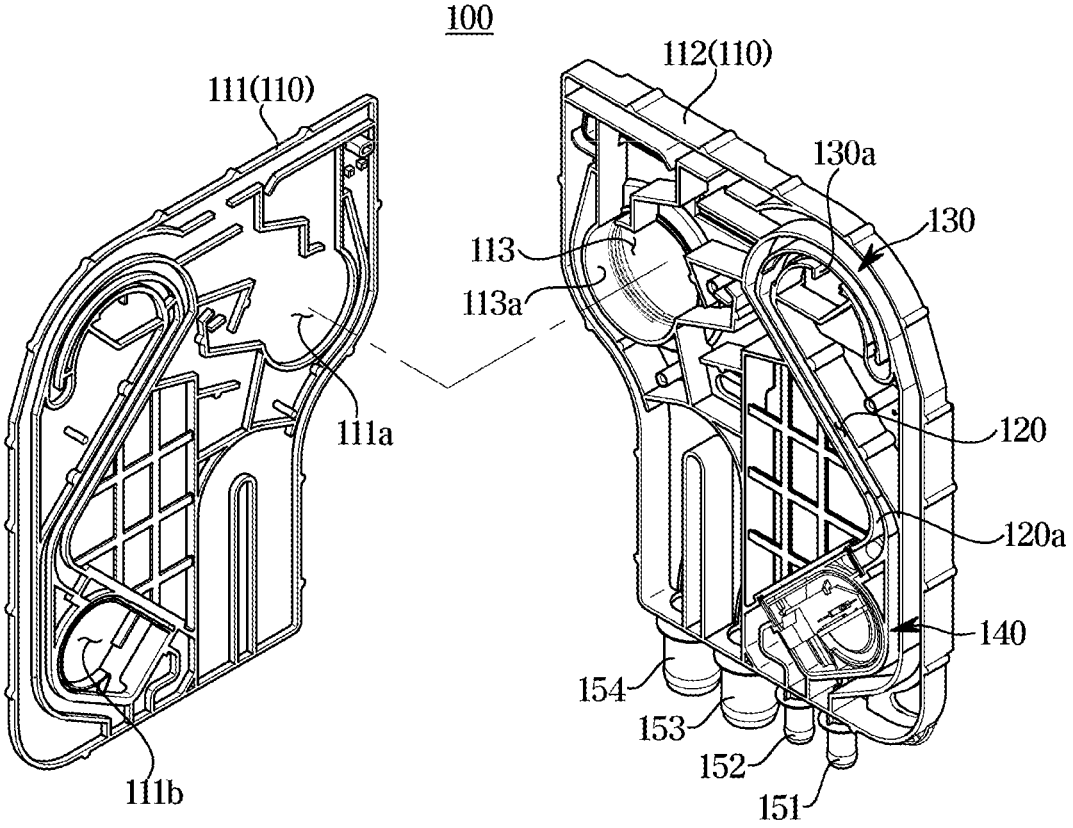
FIG. 7 is an exploded perspective view of a case of the case brake in the dish washer shown in FIG. 1.
Figure 8:
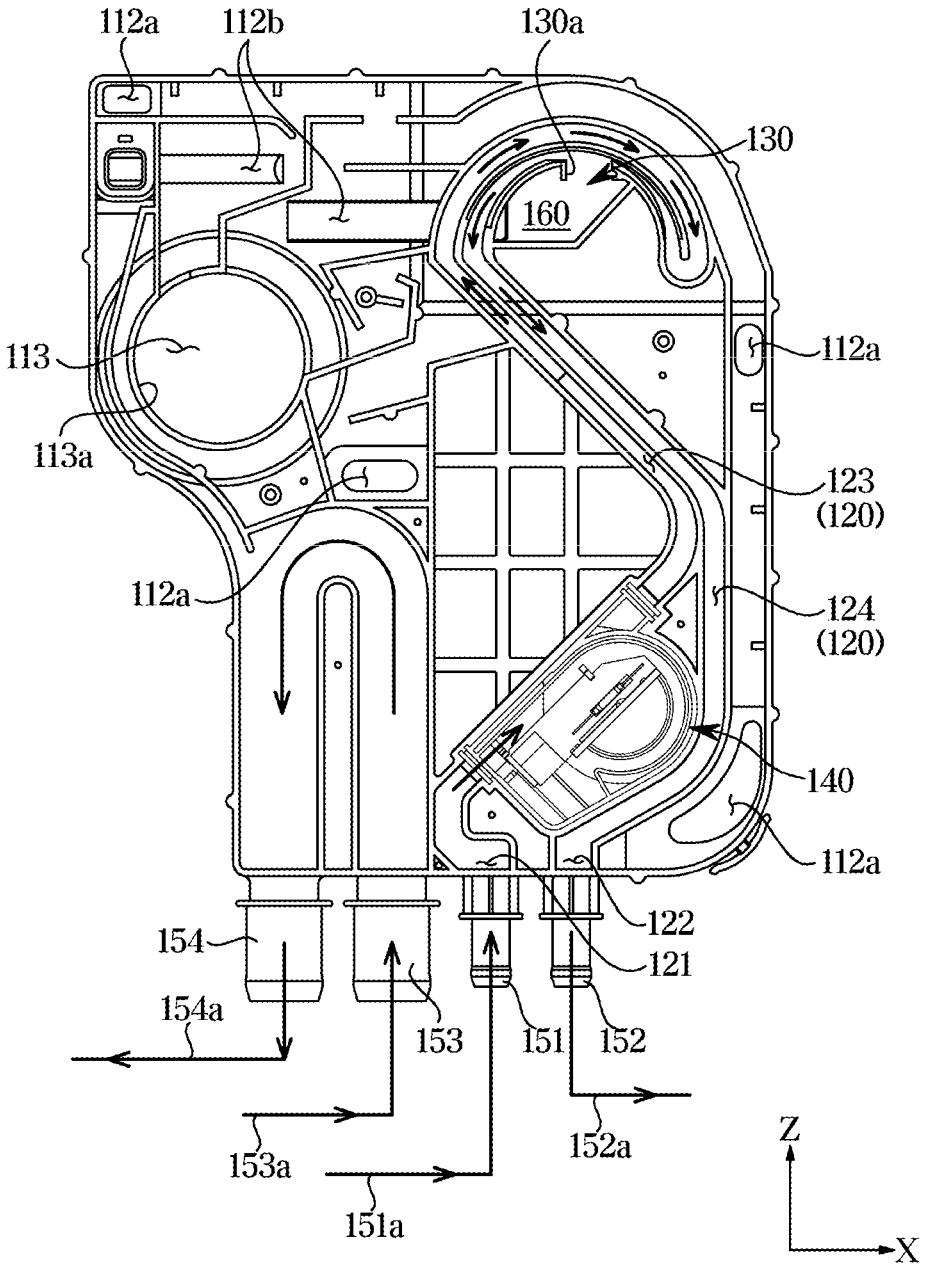
FIG. 8 is a top view of a second case of the case brake shown in FIG. 7.

FIG. 7 is an exploded perspective view of a case of the case brake in the dish washer shown in FIG. 1. FIG. 8 is a top view of a second case of the case brake shown in FIG. 7.

Referring to FIGS. 7 and 8, according to an embodiment of the disclosure, the dish washer may include the case brake 100. The case brake 100 may include the case 110, an internal flow path 120, an air brake 130, the flowmeter 140, and the plurality of tubes 150.

The case 110 may include a first case 111 and a second case 112.

The first case 111 may include a tub communicating hole cover 111*a* covering the tub communicating hole 113 provided in the second case 112, and a flowmeter cover 111*b* covering the flowpath 140 rested on the second case 112. The first case 111 may be a cover.

The tub communicating hole cover 111*a* may be provided at a location corresponding to the tub communicating hole 113 when the first case 111 is coupled with the second case 112. The flowmeter cover 111*b* may be provided at a location corresponding to the flowmeter 140 when the first case 111 is coupled with the second case 112.

The case brake 100 may include an external communicating hole 112*a*, an internal communicating portion 112*b*, and the tub communicating hole 113. The external communicating hole 112*a*, the internal communicating portion 112*b*, and the tub communicating hole 113 may be formed in the second case 112. The external communicating hole 112*a* may enable inside air of the case 110 to communicate with the outside of the dish washer to maintain balanced pressure. A location at which the external communicating hole 112*a* is formed is not limited, and the external communicating hole 112*a* may be formed at various locations, such as an upper, lower, or side portion of the second case 112. The internal communicating portion 112*b* may be formed in the second case 112 to communicate with inside air of the case 110. The internal communicating portion 112*b* may communicate with the tub communicating hole 113 and/or the external communication hole 112*a*. The tube communicating hole 113 may enable the case brake 100 to communicate with the tub 12. The case brake 100 may be coupled with the side wall 12*d* of the tub 12 through a screw temper (or a screw thread) provided in a tub communicating hole forming portion 113*a* and a screw thread (or a screw thread) of the coupling member (not shown) that is coupled with the inner side wall of the tub 12.

The case brake 100 may further include an air brake chamber 160. The air brake chamber 160 may be formed in the second case 112. The air brake chamber 160 may communicate with the air brake 130, and accommodate water discharged from an air brake hole 130*a*. The air brake chamber 160 may be connected to the internal communicating portion 112*b*. The internal communication portion 112*b* may communicate with the external communicating hole 112*a* and/or the tub communication hole 113, and accordingly, the inside of the case 110 and/or the internal flow path 120 may be maintained at balanced pressure with the atmosphere.

The internal flow path 120 may be provided inside the case 100. The internal flow path 120 may be formed by a flow path forming wall 120*a* provided inside the case 100. The internal flow path 120 may include the inlet 121 and the outlet 122. Water entered the internal flow path 120 from the filter device 200 through the inlet 121 may pass through the flowmeter 140 and the air brake 130 in order and then be supplied to the sump 70 through the outlet 122.

The internal flow path 120 may be formed through the flow path forming wall 120*a* in the case 100. The internal flow path 120 may include a first internal flow path 123 and a second internal flow path 124. The first internal flow path 123 may guide water entered the case 110 through the inlet 121 to flow to the air brake 130. The second internal flow path 124 may guide water passed through the air brake 120 to the outlet 122 such that the water is discharged toward the sump 70.

Water entered the case 110 may pass through the flowmeter 140. The flowmeter 140 may measure a flow rate, and send information about the flow rate to a controller 300 (which will be described later). The controller 300 may adjust an amount of water to be collected in the sump 70 or sprayed to the washing chamber C, based on the information received from the flowmeter 140.

Water passed through the flowmeter 140 may flow to the air brake 130 provided in an upper portion of the case 110. The air brake 130 may prevent water from flowing backward from the sump 70 to the case brake 100. Water passing through the internal flow path 120 in the case 110 may have highest potential energy at an upper end of the air brake 130. The air brake 130 may include the air brake hole 130*a* opening at its one portion. The air brake hole 130*a* may communicate with the internal communicating portion 112*b* positioned adjacent to the air brake 130. Accordingly, the air brake hole 130*a* may communicate with the external communicating hole 112*a* and/or the tub communicating hole 113 through the air brake chamber 160 and the internal communicating portion 112*b*. The air brake hole 130*a* may enable pressure of the case 110 and/or the internal flow path 120 to be balanced with atmospheric pressure.

Through the plurality of tubes 150, water may enter or be discharged from the case brake 100. The plurality of tubes 150 may be positioned in a lower portion of the case 110. The plurality of tubes 150 may be the inlet tube 151, an outlet tube 152, the sump drain connecting tube 153, and the drain hose connecting tube 154.

The inlet tube 151 may enable, as shown in FIG. 5, water passed through the filter device 200 to flow to the case brake 100. The inlet tube 151 may extend downward from the lower portion of the case 110. The inlet tube 151 may be connected to the filter device 200 through the first hose 151*a* to enable water to enter the case 110. The water entered through the inlet tube 151 may pass through the flowmeter 140. The inlet tube 151 may be a first tube 151.

The outlet tube 152 may cause water passed through the air brake 130 in the internal flow path 120 of the case brake 100 to flow to the sump 70. The outlet tube 152 may extend downward from the lower portion of the case 110. The outlet tube 152 may be connected to the sump 70 through the second hose 152*a*, and supply water to the water collecting portion 71 of the sump 70. The outlet tube 152 may be a second tube 152.

The sump drain connecting tube 153 may receive water drained from the sump 70. The sump drain connecting tube 153 may extend downward from the lower portion of the case 110. The sump drain connecting tube 153 may be connected to a sump drain tube through a third hose 153*a* so that water flows from the sump 70 to the inside of the case 110. The sump drain connecting tube 153 may be a third tube 153.

The drain hose connecting tube 154 may drain water entered the inside of the case 110 through the sump drain connecting tube 153 to the outside. The drain hose connecting tube 154 may extend downward from the lower portion of the case 110. The drain hose connecting tube 154 may be connected to the outside through a fourth hose 154*a*. The drain hose connecting tube 154 may be a fourth tube 154.

Figure 9:
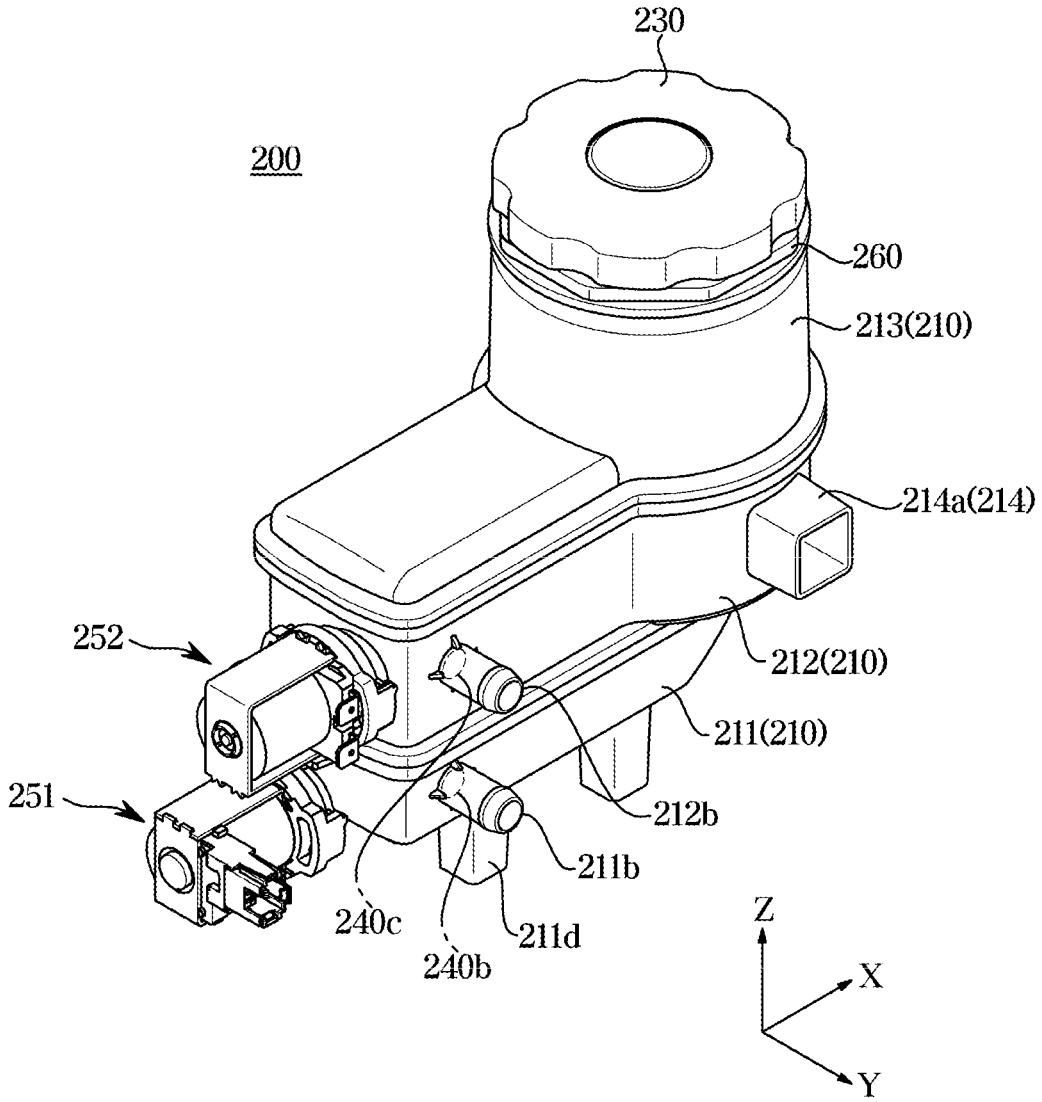
FIG. 9 is a perspective view of a filter device in the dish washer shown in FIG. 1.
Figure 10:
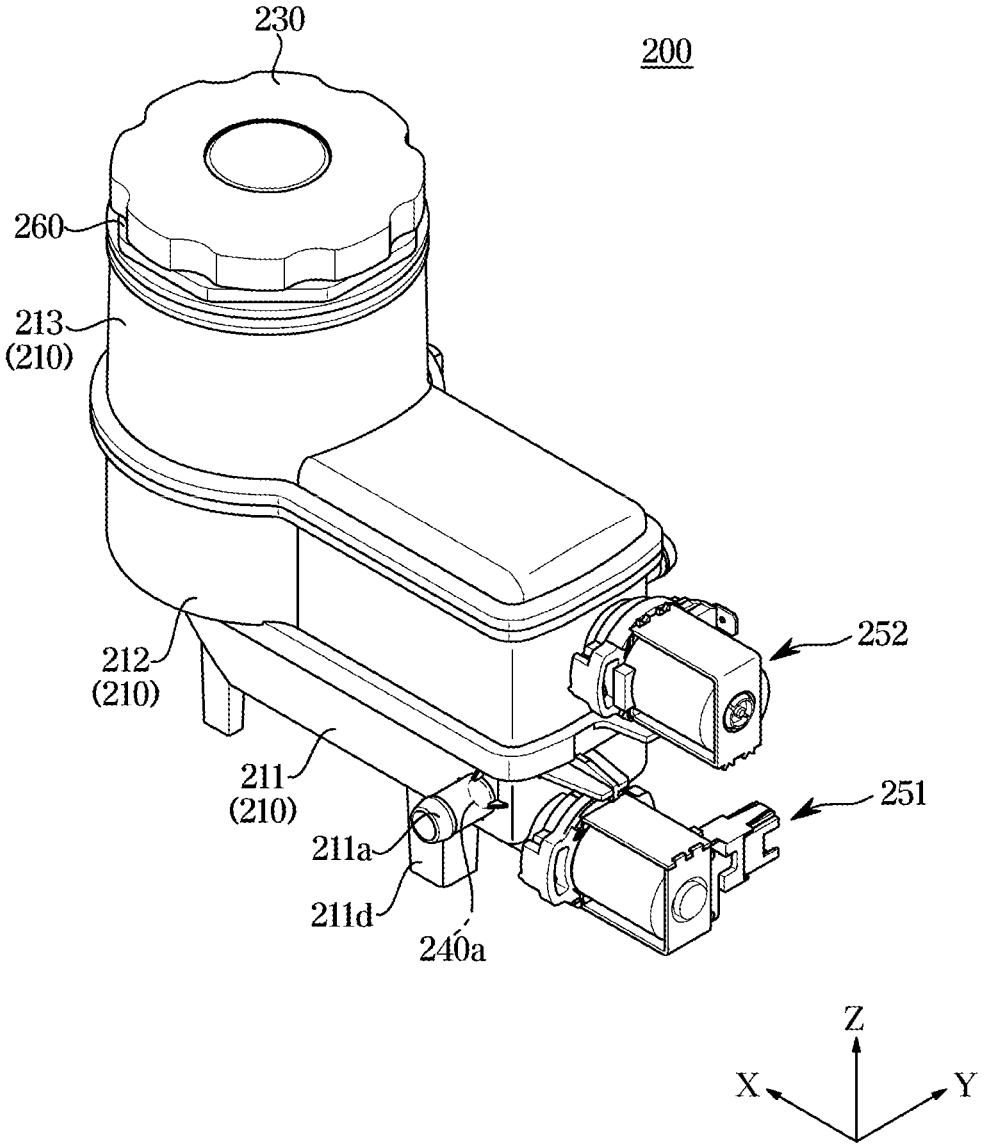
FIG. 10 is a perspective view showing the filter device shown in FIG. 9 at another angle.
Figure 11:
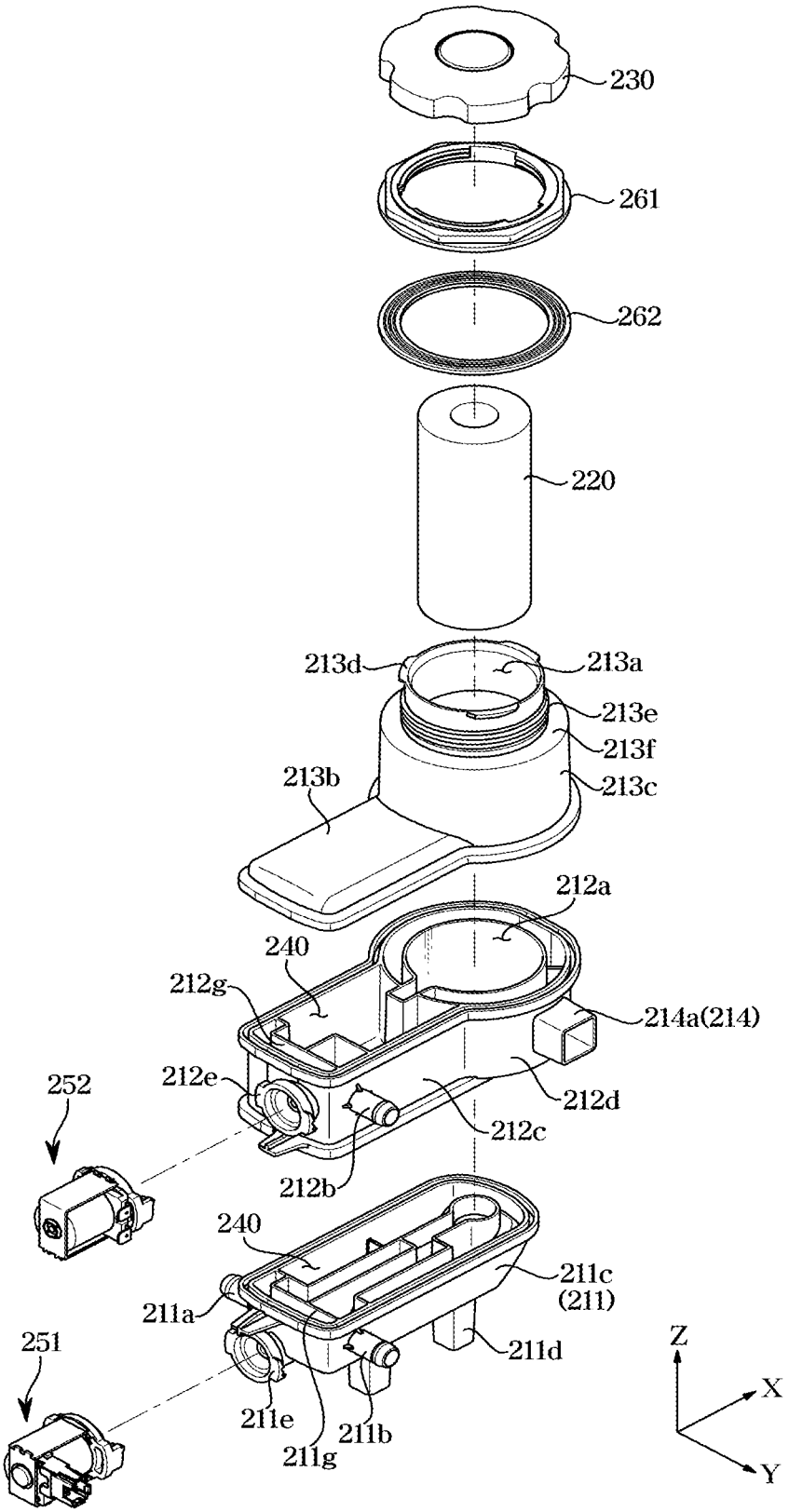
FIG. 11 is an exploded perspective view of the filter device shown in FIG. 9.
Figure 12:
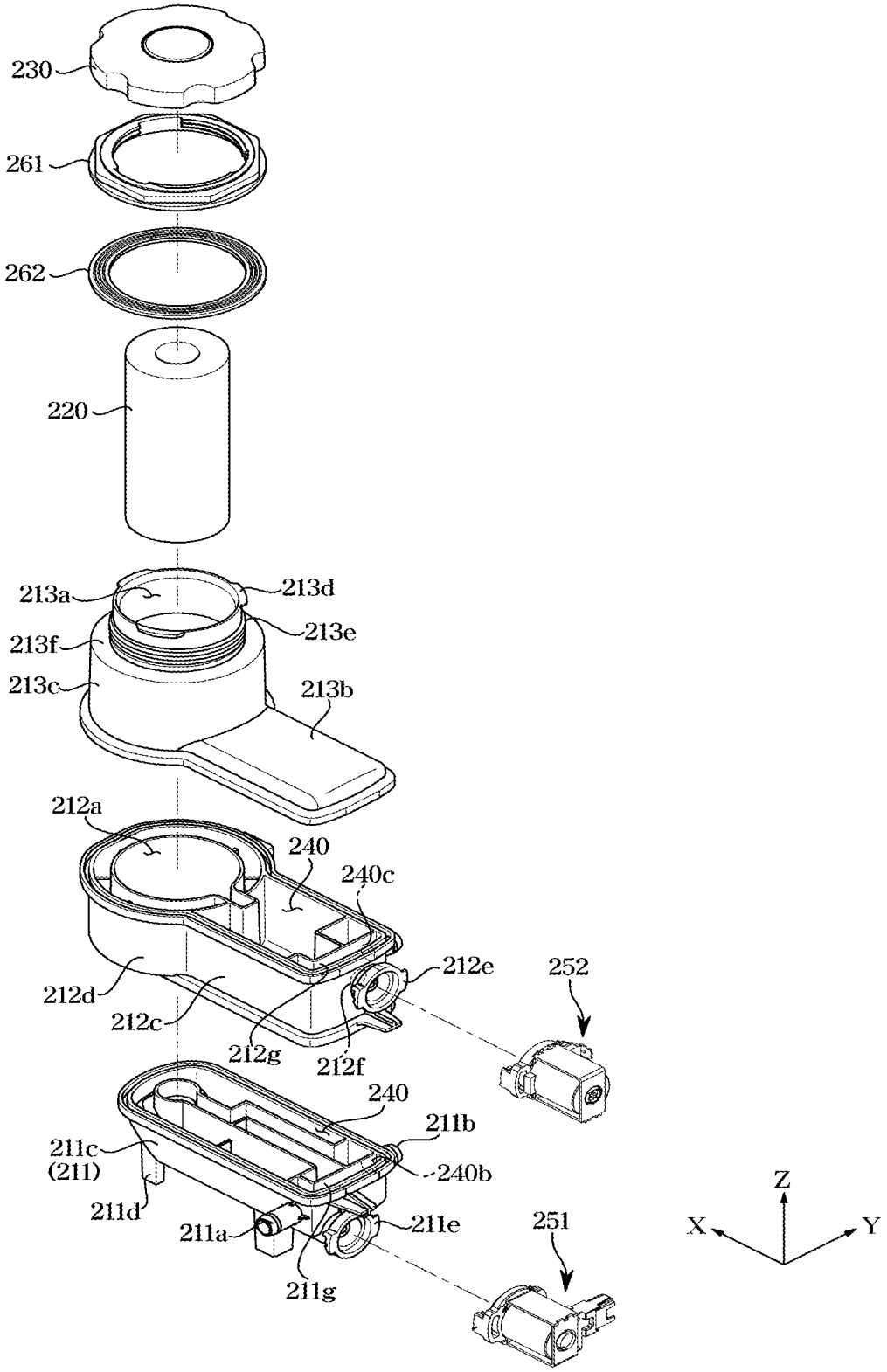
FIG. 12 is an exploded perspective view showing the filter device shown in FIG. 11 at another angle.

FIG. 9 is a perspective view of a filter device in the dish washer shown in FIG. 1. FIG. 10 is a perspective view showing the filter device shown in FIG. 9 at another angle. FIG. 11 is an exploded perspective view of the filter device shown in FIG. 9. FIG. 12 is an exploded perspective view showing the filter device shown in FIG. 11 at another angle.

Referring to FIGS. 9 to 12, the dish washer according to an embodiment of the disclosure may include the filter device 200. The filter device 200 may include the filter case 210, the case cover 230, the filter 220, the valve 250, and a holder 260. Also, the filter device 200 may include the inlet tube 211*a*, the first outlet tube 211*b*, a flow path forming portion 211*c*, a support portion 211*d*, and a first valve coupling portion 211*e*, which are formed in a first case 211. Also, the filter device 200 may include the second outlet tube 212*b*, a filter receiver 212*a*, a flow path forming portion 212*c*, a receiver cover 212*d*, and a second valve coupling portion 212*e*, which are formed in a second case 212. Also, the filter device 200 may include a filter receiver 213*a*, a flow path cover 213*b*, a receiver cover 213*c*, and a coupling portion 213*d*, which are formed in a third case 213.

The filter case 210 may be positioned below the tub 12. For example, a portion of the filter case 210 may be positioned below the tub 12, and the other portion of the filter case 210 may penetrate the bottom 12*b* of the tub 12 to be positioned inside the washing chamber C. A user may replace the filter 220 accommodated in the filter case 210 by separating the case cover 230 coupled with the filter case 210.

The filter case 210 may include the first case 211, the second case 212, and the third case 213. In the filter case 210, an internal space 240 may be formed.

In the first case 211, the inlet tube 211*a*, the first outlet tube 211*b*, the flow path forming portion 211*c*, the support portion 211*d*, and the first valve coupling portion 211*e* may be formed.

The inlet tube 211*a* may extend along a —Y direction. The inlet tube 211*a* may protrude from an outer surface of the first case 211 toward the sump 70. The inlet tube 211*a* may extend toward the sump 70. The filter device 200 may extend such that the inlet tube 211*a* receives water from the outside.

The first outlet tube 211*b* may extend along a Y direction. The first outlet tube 211*b* may protrude from an outer surface of the first case 211, which is opposite to the surface in which the inlet tube 211*a* is formed. The filter device 200 may be positioned such that the first outlet tube 211*b* extends toward the inner side surface of the cabinet 11.

The flow path forming portion 211*c* may form an outer surface of the first case 211. The flow path forming portion 211*c* may be a portion by which a flow path is formed inside the first case 211.

The support portion 211*d* may extend downward from a bottom of the first case 211. The support portion 211*d* may be in contact with the lower frame 14 and/or the bottom plate 15 to support the filter device 200, although not limited thereto. However, the support portion 211*d* may be in contact with a floor to support the filter device 200.

The first valve coupling portion 211*e* may be formed at one side of the first case 211 to be coupled with the first valve 251. The first valve coupling portion 211*e* may be formed along a —X direction in the first case 211. When the first valve 251 is coupled with the first valve coupling portion 211*e*, the first valve 251 may open a filtering flow path to cause water entered the inside of the filter case 210 to flow to the filter 220.

In the second case 212, the second outlet tube 212*b*, the filter receiver 212*a*, the flow path forming portion 212*c*, the receiver cover 212*d*, and the second valve coupling portion 212*e* may be formed.

The second outlet tube 212*b* may extend along the Y direction. The second outlet tube 212*b* may protrude from an outer surface of the second case 212. The second outlet tube 212*b* may be positioned above the first outlet tube 211*b*. The filter device 200 may be positioned such that the second outlet tube 212*b* extends toward the inner side surface of the cabinet 11.

The filter receiver 212*a* may open to accommodate the filter 220 in the second case 212. In the filter receiver 212*a*, a portion of the filter 220 may be accommodated. The flow path forming portion 212*c* may form at least one portion of the outer surface of the second case 212. The flow path forming portion 212*c* may be a portion by which a flow path is formed inside the second case 212. The receiver cover 212*d* may form at least one portion of the outer surface of the second case 212. The receiver cover 212*d* may form the filter receiver 212*a*.

The second valve coupling portion 212*e* may be formed at one side of the second case 212 to be coupled with the second valve 251. The second valve coupling portion 212*e* may be formed along a —X direction in the second case 212. When the second valve 252 is coupled with the second valve coupling portion 212*e*, the second valve 252 may open a bypass flow path to enable water entered the filter case 210 to bypass the filter 220.

Also, at one side of the second case 212, a fixing portion 214 may be provided. The fixing portion 214 may be fixed to the lower frame 14 to fix the filter case 210 inside the dish washer. The fixing portion 214 may include a first fixing portion 214*a* and a second fixing portion 214*b*.

In the third case 213, the filter receiver 213*a*, the flow path cover 213*b*, the receiver cover 213*c*, and the coupling portion 213*d* may be formed.

The filter receiver 213*a* may open to accommodate the filter 220 in the third case 213. A portion of the filter 220 may be accommodated in the filter receiver 213*a*. The flow path cover 213*b* may form at least one portion of a top surface of the third case 213. The flow path cover 213*b* may cover the filtering flow path and/or the bypass flow path in the filter case 210. The receiver cover 213*c* may form at least one portion of an outer surface of the third case 213. The receiver cover 213*c* may form the filter receiver 213*a*.

The coupling portion 213*d* may be detachably coupled with the case cover 230. The coupling portion 213*d* may be formed in an upper portion of the third case 213. The case cover 230 may be rotatably coupled with the coupling portion 213*d*. For example, by rotating the case cover 230 in one direction, the case cover 230 may be separated from or coupled with the coupling portion 213*d*.

The filter 220 may be positioned inside the filter case 210 to filter water entered inside of the filter case 210. The filter 220 may be positioned on a flow path inside the filter case 210. For example, the filter 220 may be positioned on the filtering flow path. A flow path not passing through the filter 220 inside the filter case 210 may be the bypass flow path.

The valve 250 may open or close the filtering flow path and/or the bypass flow path. A plurality of valves 250 may be provided. The plurality of valves 250 may include various kinds of valves. For example, the plurality of valves 250 may include a solenoid valve. However, the kind of the valve 250 is not limited to this. The plurality of valves 250 may include the first valve 251 and the second valve 252.

The first valve 251 may be coupled with one side of the first case 211. The first valve 251 may be coupled with the first valve coupling portion 211*e* formed in the first case 211. The first valve 251 may open or close the filtering flow path. When the first valve 251 opens the filtering flow path, water existing in the filter case 210 may be filtered by the filter 220 and then flow to the case brake 100.

The second valve 252 may be coupled with one side of the second case 212. The second valve 252 may be coupled with the second valve coupling portion 212*e* formed in the second case 212. The second valve 252 may open or close the bypass flow path. When the second valve 252 opens the bypass flow path, water existing in the filter case 210 may bypass the filter 220 and then flow to the case brake 100.

The first valve 251 and the second valve 252 may operate selectively by the controller 300 which will be described later.

A holder 260 may fix, when a portion of the filter case 210 protrudes to the inside of the tub 12, the filter device 200 on the bottom 12*b* of the tub 12, and seal a space between the bottom 12*b* of the tub 12 and the case cover 230. The holder 260 may be coupled with the filter case 210. For example, the holder 260 may be coupled with the third case 213. The holder 260 may cover a circumference of the third case 213. The holder 260 may include a first holder 261 and a second holder 262.

Figure 13:
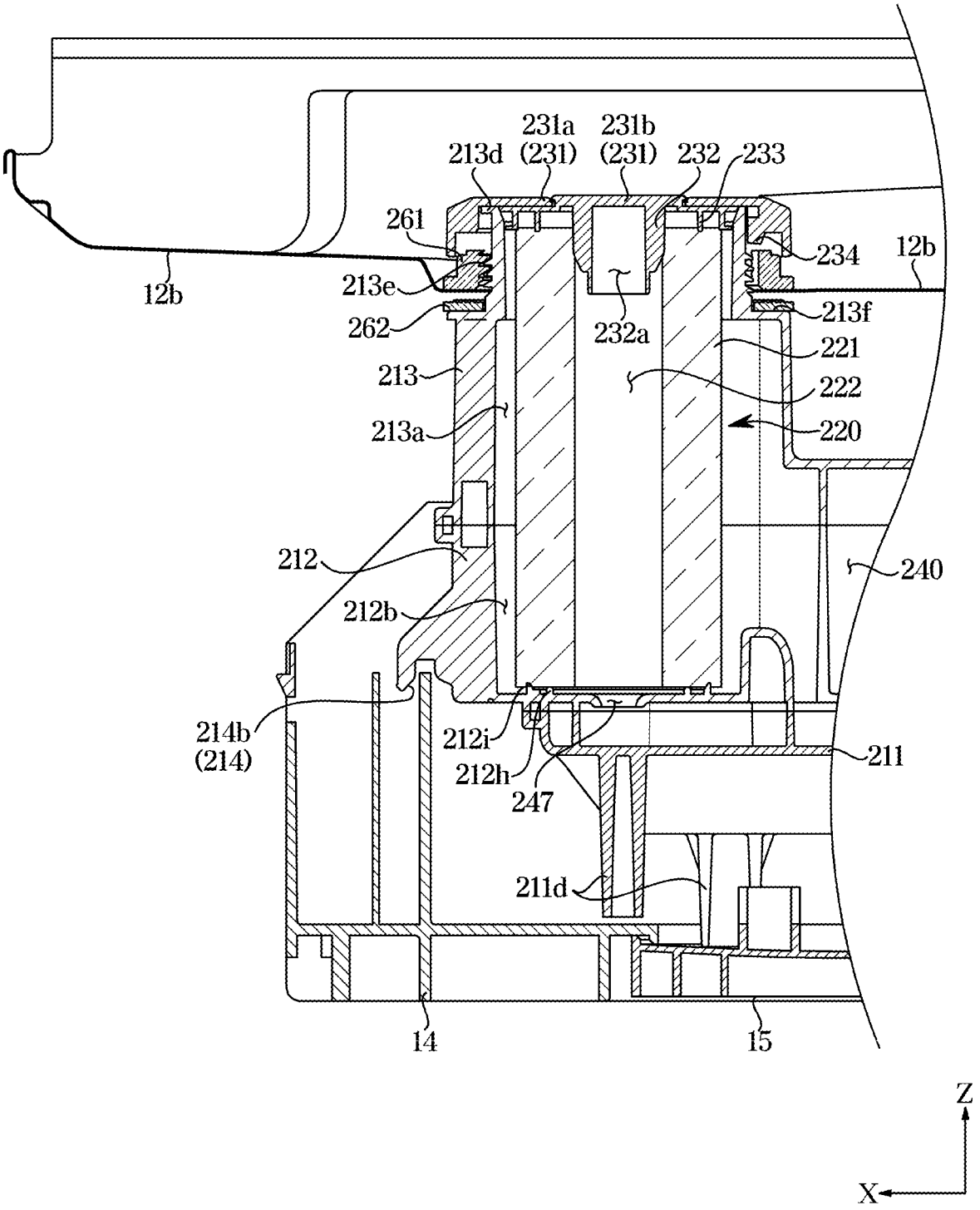
FIG. 13 is a cross-sectional view of the dish washer shown in FIG. 3.

FIG. 13 is a cross-sectional view of the dish washer shown in FIG. 3. FIG. 13 shows a cross section taken along A-A' in FIG. 3.

Referring to FIG. 13, the filter device 200 of the dish washer according to an embodiment of the disclosure may include the filter 220 accommodated in the second case 212 and the third case 213. The filter 220 may be positioned in the receiver 212*a* of the second case 212 and the receiver 213*a* of the third case 213.

The filter 220 may include a filter portion 221 and a hollow portion 222. The filter portion 221 may filter water entered the filter case 210. The hollow portion 222 may be formed at a center of the filter 220.

The filter device 200 may include the case cover 230 covering the filter case 210 and/or a top of the filter 220. The case cover 230 may include a cover 231, an insertion protrusion 232, a fixing protrusion 233, and an interference rib 234.

The cover portion 231 may cover the filter case 210 and/or the top of the filter 220. The cover portion 231 may include a first cover 231*a* and a second cover 231*b*. The first cover 231*a* may be provided around the second cover 231*b*.

The insertion protrusion 232 may be inserted in the hollow portion 222. The insertion protrusion 232 may extend downward from the cover portion 231. The insertion protrusion 232 may fix the filter 220 inside the filter case 210. In the insertion protrusion 232, a hole 232*a* may be formed.

The fixing protrusion 233 3se 210. The fixing protrusion 233 may extend downward from the cover portion 231. A plurality of fixing protrusions 233 may be provided. When a user separates the case cover 230 from the filter case 210 and takes the filter 220 out of the receivers 212*a* and 213*a*, the filter 220 may be separated and/or spaced from the filter case 210 together with the case cover 230, in the state in which the filter 220 is coupled with the fixing protrusion 233. Accordingly, the user may take the filter 220 out of the filter case 210 without having to take the filter 220 out with his/her hand, resulting in an increase of convenience.

The interference rib 234 may interfere with the coupling portion 213*d* of the third case 213. The interference rib 234 may prevent coupling between the filter case 210 and the case cover 230 from being released. The interference rib 234 may be formed to correspond to the coupling portion 213*d* of the third case 213. A plurality of interference ribs 234 may be provided.

The second case 212 may include a resting portion 212*b* and a resting protrusion 212*i*. The filter 220 may be rested on the second case 212. The resting portion 212*h* may protrude upward from a bottom of the second case 212. The resting protrusion 212*i* may be inserted into inside of the filter portion 221. The resting protrusion 212*i* may also protrude upward from the bottom of the second case 212.

In the bottom of the second case 212, a flow path communicating hole 247 may be formed. The flow path communicating hole 247 may enable water passed through the filter in the filtering flow path which will be described later to flow to a fifth flow path 245. The flow path communicating hole 247 may be connected to the fifth flow path 245. The flow path communicating hole 247 may be formed at a location corresponding to the hollow portion 222 along an up-down direction.

The second fixing portion 214*b* may be provided at one side of the second case 212. The second fixing portion 214*b* may include a curved shape. The second fixing portion 214*b* may fix the filter case 210 to the lower frame 14. The filter device 200 may include the holder 260. The holder 260 may be coupled with the third case 213. The holder 260 may cover the circumference of the third case 213. A plurality of holders 260 may be provided. The plurality of holders 260 may include the first holder 261 and the second holder 262.

When the filter case 210 is coupled with the bottom 12*b* of the tub 12, the first holder 261 may be positioned on an upper side of the bottom 12*b*, and the second holder 262 may be positioned on a lower side of the bottom 12*b*. The first holder 261 may be coupled with the third case 213 through the screw thread 213*e* of the third case 213. When a portion of the filter case 210 protrudes to the inside of the tub 12, the first holder 261 may fix the filter device 200 on the bottom 12*b* of the tub 12, and seal a space between the bottom 12*b* of the tub 12 and the case cover 230. The second holder 262 may be positioned on an upper surface of one side 213*f* of the third case 213 and supported by the one side 213*f*.

Figure 14:
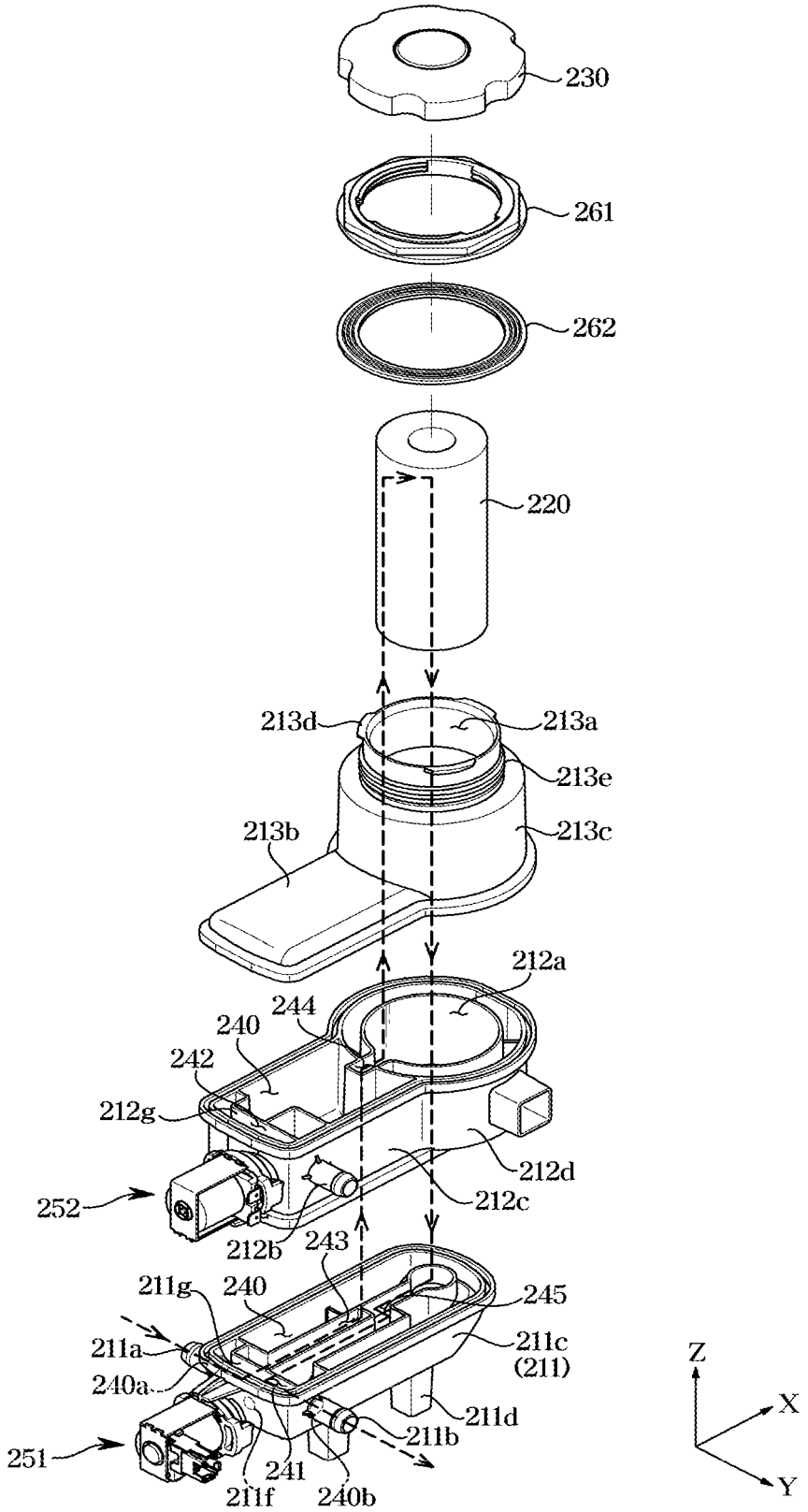
FIG. 14 schematically shows a process by which water flows along a filtering flow path in the filter device shown in FIG. 10.

FIG. 14 schematically shows a process by which water flows along a filtering flow path in the filter device shown in FIG. 10.

Referring to FIG. 14, according to an embodiment of the disclosure, when the first valve 251 operates, the filtering flow path may open, and water entered the inside of the filter case 210 may be filtered. The filtering flow path may include an inlet 240*a*, a first flow path 241, a third flow path 243, a fourth flow path 244, a fifth flow path 245, and a first outlet 240*b*. At this time, the second valve 252 may not operate to close the bypass flow path.

Hereinafter, a process of filtering water will be described.

Water may enter from the outside of the dish washer through the inlet tube 211*a*. The water passed through the inlet tube 211*a* may flow to the first flow path 241 through the inlet 240*a*. The water entered the first flow path 241 may enter an internal flow path of the first valve 251 and then be discharged from the first valve 251. The water passed through the first valve 251 may flow to the third flow path 243 extending along an X direction through a hole 211*f* formed in a flow path forming wall 211*g*. The water passed through the third flow path 243 may flow upward to flow to the fourth flow path 244 formed in the second case 212. The water passed through the fourth flow path 244 may flow to the filter 220. The water passed through the filter 220 may be filtered and flow downward. The water passed through the filter 220 may flow to the fifth flow path 245 provided in the first case 211. For example, water passed through the fourth flow path 244 may pass through the filter portion 221 to flow to the hollow portion 222, and then pass through the flow path communicating hole 247 through the hollow portion 222. The water passed through the flow path communicating hole 247 may head to the fifth flow path 245. The water passed through the fifth flow path 245 may flow to the case brake 100 through the first outlet 240*b* and the first outlet tube 211*b*.

In the drawing, for convenience of description, the filter 220 is shown to be separated, however, a filtering process may be performed in the state in which the filter 220 is accommodated in the filter receivers 212*a* and 213*a*.

Figure 15:
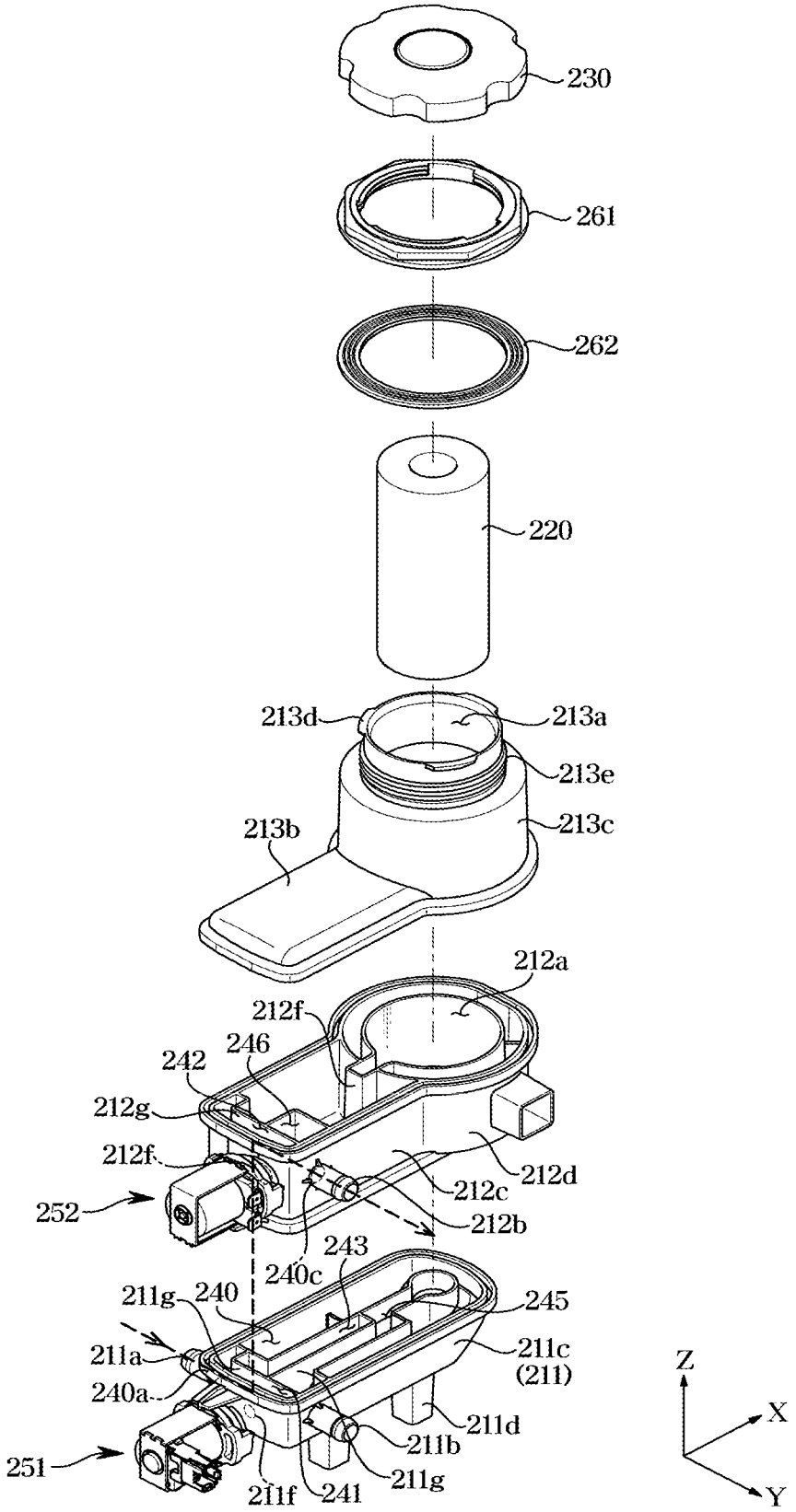
FIG. 15 schematically shows a process by which water flows along a bypass flow path in the filter device shown in FIG. 10.

FIG. 15 schematically shows a process by which water flows along a bypass flow path in the filter device shown in FIG. 10.

Referring to FIG. 15, according to an embodiment of the disclosure, when the second valve 252 operates, water entered the inside of the filter case 210 may bypass the filter 220. That is, the water may directly flow to the case brake 100 without being purified. The bypass flow path may include the inlet 240*a*, the first flow path 241, a second flow path 242, and the second outlet 240*c*. At this time, the first valve 251 may not operate to close the filtering flow path.

Hereinafter, a process by which water bypasses the filter 220 will be described.

Water may enter from the outside of the dish washer through the inlet tube 211*a*. The water passed through the inlet tube 211*a* may flow to the first flow path 241 through the inlet 240*a*. The water entered the first flow path 241 may flow to the second flow path 242 provided in the second case 212. The water entered the second flow path 242 may enter an internal flow path of the second valve 252 and then be discharged from the second valve 252. The water passed through the second valve 252 may flow to a sixth flow path 246 through a hole 212*f* formed in a flow path forming wall 212*g*. The sixth flow path 246 may be connected to the second outlet 240*c*, and the water may flow to the case brake 100 through the second outlet tube 212*b*.

That is, when the first valve 251 closes the filtering flow path and the second valve 252 operates to open the bypass flow path, water entered the inside of the filter case 210 may directly flow to the case brake 100 without passing through the filter 220.

Figure 16:
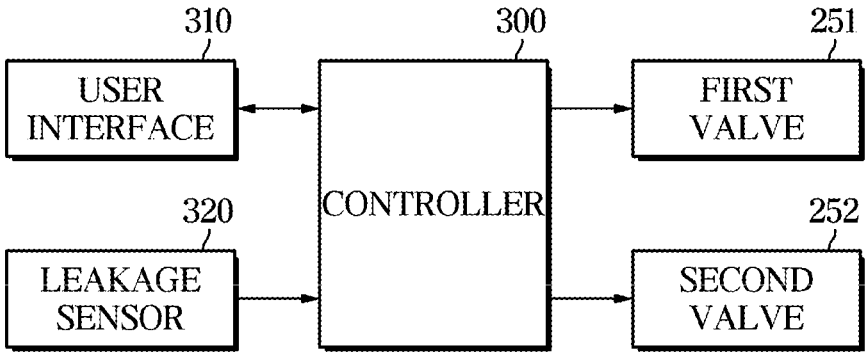
FIG. 16 is a control block diagram of a dish washer according to an embodiment of the disclosure.

FIG. 16 is a control block diagram of a dish washer according to an embodiment of the disclosure.

Referring to FIG. 16, the dish washer according to an embodiment of the disclosure may further include the controller 300, the user interface 310, and the leakage sensor 320. The controller 300 may be provided in the main body 10, the user interface 310 may be provided in the door 20, and the leakage sensor 320 may be provided in the machine room L. For example, the leakage sensor 320 may be positioned on the bottom plate 15. However, locations of the controller 300, the user interface 310, and the leakage sensor 320 are not limited to the above-mentioned examples, and the controller 300, the user interface 310, and the leakage sensor 320 may be positioned at various locations.

The controller 300 may control the first valve 251 and the second valve 252. For example, the controller 300 may operate one of the first valve 251 and the second valve 252 to selectively open or close the filtering flow path and the bypass flow path. For example, when the dish washer operates, the controller 300 may control the second valve 252 to open the bypass flow path, and the first valve 251 to close the filtering flow path. When a final rinsing operation is performed, the controller 300 may control the valves 250 such that the first valve 251 opens the filtering flow path to pass water to be supplied to the sump 70 through the filter 220, and the second valve 252 closes the bypass flow path.

The dish washer may include a plurality of washing courses. For example, the dish washer may include an automatic course, a normal course, a strong course, and/or a quick course. The number and/or kinds of operations applied to each course of the dish washer may change. The dish washer may receive a selection of a washing course through the user interface 310.

The dish washer may include at least one operation. For example, the dish washer may include a preliminary washing operation, a main washing operation, a rinsing operation, and/or a drying operation. The preliminary washing operation, the main washing operation, the rinsing operation, and/or the drying operation may be performed sequentially. However, the kinds of operations of the dish washer are not limited to the above-mentioned examples. The dish washer may include at least one operation of spraying water. When an operation of spraying water is performed, water supplied to the sump 70 through the water supply source 400 may be used. For example, when an operation of spraying water is performed, water passed through the water supply source 400, the filter device 200, and the case brake 100 sequentially may be supplied to the sump 70.

The dish washer may include at least one rinsing operation of rinsing dishes. When a rinsing operation is performed, water flowing from the water supply source 400 to the filter device 200 may pass through the filter 220 or bypass the filter 220. For example, water flowing from the water supply source 400 to the inside of the filter case 210 may pass through the filtering flow path or flow on the bypass flow path.

At this time, the controller 300 may cause water filtered through the filter 220 to flow to the sump 70 in a final rising operation among the at least one rinsing operation. The controller 300 may control the plurality of valves 250 such that the first valve 251 opens the filtering flow path and the second valve 252 closes the bypass flow path, although not limited thereto. However, the controller 300 may cause water to pass through the filter 220 or not pass through the filter 220 in all of a plurality of rinsing operations, or may cause water to pass through the filter 220 only in a first rinsing operation. Accordingly, because filtered water passed through the filter 220 is used in a final rinsing operation or in a specific rinsing operation instead that filtered water is used in all operations of spraying water, a life cycle of the filter 220 may extend. Because the life cycle of the filter 220 extends, maintenance cost of the dish washer may be reduced.

The user interface 310 may receive an input signal from a user. For example, the user interface 310 may be provided on the door 20. A user may make a setting of causing water to be supplied to the sump 70 to pass through the filter 220 or bypass the filter 220. The user may determine whether to pass water through the filter 220 according to a kind of an operation.

For example, the user may select whether to filter water through the filter 220 for each operation of the dish washer through the user interface 310. The controller 300 may receive a user input through the user interface 310 to open the filtering flow path or the bypass flow path.

For example, the dish washer may include at least one operation, and the user may make an input of causing water to pass through the filter 220 only in a final rinsing operation and causing water to bypass the filter 220 in the other operations, on the user interface 310, although not limited thereto. However, the user may make a setting of causing water to bypass the filter 220 in all operations.

Accordingly, because filtered water is used only in a user's desired operation, the user's ease of use may be improved.

The user interface 310 may receive an input signal from a user, and transfer the input signal to the controller 300. The controller 300 may selectively open or close one of the first valve 251 or the second valve 252 according to the user's input. For example, when a user inputs a signal for causing water to be supplied to the sump 70 to pass through the filter 220, the controller 300 may control the first valve 251 to open the filtering flow path. Also, when a user inputs a signal for causing water to be supplied to the sump 70 to bypass the filter 220, the controller 300 may control the second valve 252 to open the bypass flow path.

Accordingly, because filtered water passed through the filter 220 is used only in a user's desired operation instead that filtered water is used in all operations of spraying water, a life cycle of the filter 220 may extend. Because the life cycle of the filter 220 extends, maintenance cost of the dish washer 1 may be reduced.

The leakage sensor 320 may sense water leaking out of the filter device 200 and transfer a signal to the controller 300. For example, because the leakage sensor 320 is provided on the bottom plate 15, the leakage sensor 320 may sense leakage of the filter device 200 and transfer information about whether leakage has occurred to the controller 300. At this time, when the controller 300 recognizes that leakage has occurred in the filter device 200, the controller 300 may control the user interface 310 to display leakage. In other words, when water has leaked out of the filter device 200, the leakage sensor 320 may transfer a signal to the controller 300, and the controller 300 may control the user interface 310 to display a leak warning.

Also, the controller 300 may operate the first valve 251 and/or the second valve 252 according to an amount of water passed through the filter device 200 and flowing to the flowmeter 140.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A dish washer comprising:

a cabinet;

a tub disposed in the cabinet;

a sump provided in a lower portion of the tub;

a case brake provided on a side wall of the tub; and a filter device disposed below the tub in the cabinet, to selectively filter or unfilter water received from a water supply source, the filter device including:

a filter case which a filter is insertable or removable therefrom;

a filtering flow path formed in the filter case to cause the water entered to the filter case to flow to the filter thereby filtering the entered water; and a bypass flow path formed in the filter case to bypass the filter thereby unfiltering the entered water, wherein the case brake is connected to the filter device and the sump, respectively, and is configured to guide the filtered water or the unfiltered water received from the filter device to the sump, the water passed through the case brake is collected in the sump, and the case brake is located higher than the sump to prevent a backflow of the water collected in the sump to the case brake.

2. The dish washer of claim 1, further comprising a machine room provided below the tub in the cabinet, and wherein the filter device is installed in the machine room, and the filter case is disposed in the machine room and protruded toward inside of the tub such that a portion of the filter case is positioned in the inside of the tub.

3. The dish washer of claim 2, wherein the filter case comprises:

a first case to support the filter device inside the machine room;

a second case disposed above the first case; and a third case disposed above the second case and penetrated a bottom of the tub to protrude to the inside of the tub such that the portion of the filter case is disposed in the inside of the tub.

4. The dish washer of claim 3, wherein the filter device further includes a case cover detachably coupled with the third case and positioned inside the tub.

5. The dish washer of claim 4, wherein the filter is accommodated in the second case and the third case, and the third case includes a coupling portion provided in an upper portion of the third case and couplable with the case cover, the coupling portion located higher than the bottom of the tub so that the filter is insertable to or removable from the filter case via the inside of the tub.

6. The dish washer of claim 5, wherein the case cover comprises:

a cover portion to cover a top of the filter; and a fixing protrusion protruded from the cover portion to be fixed to the filter.

7. The dish washer of claim 1, wherein the case brake comprises:

a case;

an internal flow path formed in the case and through which the filtered water or the unfiltered water from the filter device flows, the internal flow path including:

an inlet through which the filtered water or the unfiltered water from the filter device enters; and an outlet provided in a lower portion of the case so that the water, flows through the internal flow path, is supplied to the sump, the outlet located higher than the sump;

an air brake provided at an upper end on the internal flow path to prevent the backflow of water from the sump to the case; and an air brake hole formed in the air brake such that inside pressure of the internal flow path is balanced with outside pressure of the case.

8. The dish washer of claim 1, wherein the filter device further comprises:

a first valve to open the filtering flow path so that the water passed through the filter flows to the case brake; and a second valve to open the bypass flow path so that water bypassed the filter flows to the case brake.

9. The dish washer of claim 8, further comprising a controller to selectively operate the first valve to open or close the filtering flow path or the second valve to open or close the bypass flow path.

10. The dish washer of claim 9, wherein the controller to perform a plurality of rinsing operations including spraying water inside the tub, and controls the first valve to open the filtering flow path in a final rinsing operation among the plurality of rinsing operations such that filtered water flows to the case brake.

11. The dish washer of claim 10, further comprising a user interface to receive a user input, and wherein the controller selectively operates the first valve or the second valve based on the received user input.

* * * * *